US007669412B2

(12) United States Patent
Ashida et al.

(10) Patent No.: US 7,669,412 B2
(45) Date of Patent: Mar. 2, 2010

(54) EXHAUST MANIFOLD FOR INTERNAL COMBUSTION ENGINE

(75) Inventors: Masaaki Ashida, Yokohama (JP); Sunkee Yi, Kanagawa (JP); Takao Inoue, Yokohama (JP); Shunichi Mitsuishi, Kanagawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 1492 days.

(21) Appl. No.: 10/998,936

(22) Filed: Nov. 30, 2004

(65) Prior Publication Data

US 2005/0115231 A1 Jun. 2, 2005

(30) Foreign Application Priority Data

| | | |
|---|---|---|
| Dec. 1, 2003 | (JP) | 2003-400990 |
| Mar. 11, 2004 | (JP) | 2004-068273 |
| Mar. 11, 2004 | (JP) | 2004-068274 |
| Mar. 11, 2004 | (JP) | 2004-068275 |
| Mar. 11, 2004 | (JP) | 2004-068276 |

(51) Int. Cl.
*F01N 7/10* (2006.01)

(52) U.S. Cl. ..... 60/323; 60/313; 60/324

(58) Field of Classification Search ..... 60/312, 60/313, 323, 324
See application file for complete search history.

(56) References Cited

U.S. PATENT DOCUMENTS

| | | | | |
|---|---|---|---|---|
| 2,388,924 | A * | 11/1945 | Mercier | 60/323 |
| 3,797,241 | A * | 3/1974 | Kern | 60/305 |
| 5,144,800 | A | 9/1992 | Shioya et al. | |
| 5,689,954 | A * | 11/1997 | Blocker et al. | 60/322 |
| 5,956,949 | A * | 9/1999 | Mayer et al. | 60/301 |
| 6,009,706 | A | 1/2000 | Haneda | |
| 6,134,886 | A | 10/2000 | Bussmann et al. | |
| 6,321,532 | B1 | 11/2001 | Komush | |
| 2001/0009208 | A1 | 7/2001 | Fuhrmann et al. | |

FOREIGN PATENT DOCUMENTS

| | | |
|---|---|---|
| DE | 31 06 572 A1 | 2/1982 |
| DE | 197 45 269 A1 | 4/1999 |
| DE | 100 02 240 B4 | 7/2001 |
| EP | 0 731 258 A1 | 9/1996 |
| EP | 1 103 701 B1 | 5/2001 |
| EP | 1 213 454 B1 | 6/2002 |
| EP | 1 245 802 B1 | 10/2002 |
| EP | 1 388 650 B1 | 2/2004 |
| EP | 1 538 315 A2 | 6/2005 |
| JP | 03-009016 A | 1/1991 |

(Continued)

*Primary Examiner*—Tu M Nguyen
(74) *Attorney, Agent, or Firm*—Foley & Lardner LLP

(57) ABSTRACT

An exhaust manifold connected to exhaust ports of at least three straightly-arranged cylinders of an internal combustion engine is constructed by a primary exhaust pipe which extends from the foremost cylinder of the cylinders in the rearward direction of the engine along the direction of the straight arrangement of the cylinders and a plurality of secondary exhaust pipes which extend from the other cylinders except for the foremost cylinder to the primary exhaust pipe. The secondary exhaust pipes are collected to the primary exhaust pipe so that downstream end portions of the secondary exhaust pipes are wound into the center axis of the primary exhaust pipe at a plurality of points on the center axis, respectively.

29 Claims, 21 Drawing Sheets

FOREIGN PATENT DOCUMENTS

| | | | |
|---|---|---|---|
| JP | 03-082826 | U | 8/1991 |
| JP | 06-069321 | U | 9/1994 |
| JP | 10-311220 | A | 11/1998 |
| JP | 10-317953 | A | 12/1998 |
| JP | 2001-208254 | A | 8/2001 |
| JP | 2003-027986 | A | 1/2003 |
| JP | 2003-269160 | A | 9/2003 |
| WO | WO 97/13965 | | 4/1997 |

* cited by examiner

EXHAUST MANIFOLD FOR INTERNAL COMBUSTION ENGINE

BACKGROUND OF THE INVENTION

The present invention relates an exhaust manifold for an internal combustion engine, and more particularly to improvements in an exhaust manifold of collecting exhaust passages for straightly arranged cylinders into one passage.

Japanese Published Patent Application No. 10-317953 discloses an exhaust manifold applied to an exhaust system for one bank of a V-8 engine. The exhaust manifold comprises a straight collection pipe and four branch pipes connected to exhaust ports of cylinders. The four branch pipes are arranged in parallel and are connected to the collection pipe so that an upper periphery of each branch pipe is aligned with a tangent at a top of circular cross-section of the collection pipe. Further, each branch pipe is collected into the collection pipe at a confluence angle of 67.5° or less.

SUMMARY OF THE INVENTION

However, a length of an exhaust passage from an exhaust port of each cylinder to an outlet of the collection pipe becomes different from those of other exhaust passages of other cylinders since the lengths of the branch pipes are substantially equal. For example, the exhaust passage for the cylinder farthest from the outlet of the collection pipe is the longest pipe, and the exhaust passage for the cylinder nearest to the outlet of the collection pipe, in this prior art. When the lengths of the exhaust passages become different substantially, sounds slightly different from exhaust pulsation in frequency are overlapped on the exhaust pulsation. This degrades the sound quality of exhaust, and such degraded exhaust sounds noisy. Further, since the confluence angles of the branch pipes relative to the collection pipe is relatively large, the flowing direction of the exhaust gas is largely changed in the collecting pipe, and therefore a pressure drop of the exhaust passage increases so as to affect the output performance of the engine. Further, from the viewpoint of a quick activation of a catalytic converter, it is preferable that a total length of an exhaust manifold is shortened as possible.

It is therefore an object of the present invention to provide an improved exhaust manifold which achieves both of equalization and shortening of the lengths of exhaust passages of cylinders and which decreases the pressure loss itself.

An aspect of the present invention resided in an exhaust manifold connected to exhaust ports of at least three straightly-arranged cylinders of an internal combustion engine. The exhaust manifold comprises a primary exhaust pipe which extends from the foremost cylinder of the cylinders in the rearward direction of the engine along the direction of the straight arrangement of the cylinders and a plurality of secondary exhaust pipes which extends from the other cylinders except for the foremost cylinder to the primary exhaust pipe. The secondary exhaust pipes is collected to the primary exhaust pipe so that downstream end portions of the secondary exhaust pipes are wound into the center axis of the primary exhaust pipe at a plurality of points on the center axis, respectively.

The other objects and features of this invention will become understood from the following description with reference to the accompanying drawings.

BRIEF DESCRIPTION OF THE DRAWINGS

As shown in FIG. 21, a partition plate 121 is welded at a center portion of oval inlet portion 112*a* of intermediate pipe 112 so that inlet portion 112*a* is partitioned into a θ-shape portion constructed by two D-shaped openings.

FIG. 21 is a perspective views showing an inlet portion of the intermediate pipe shown in FIG. 12.

FIG. 22 is a perspective views showing an outlet portion of the intermediate pipe shown in FIG. 12.

DETAILED DESCRIPTION OF THE INVENTION

Hereinafter, there are discussed embodiments of an exhaust manifold of an internal combustion engine in accordance with the present invention, with reference to the drawings.

Figure 1:
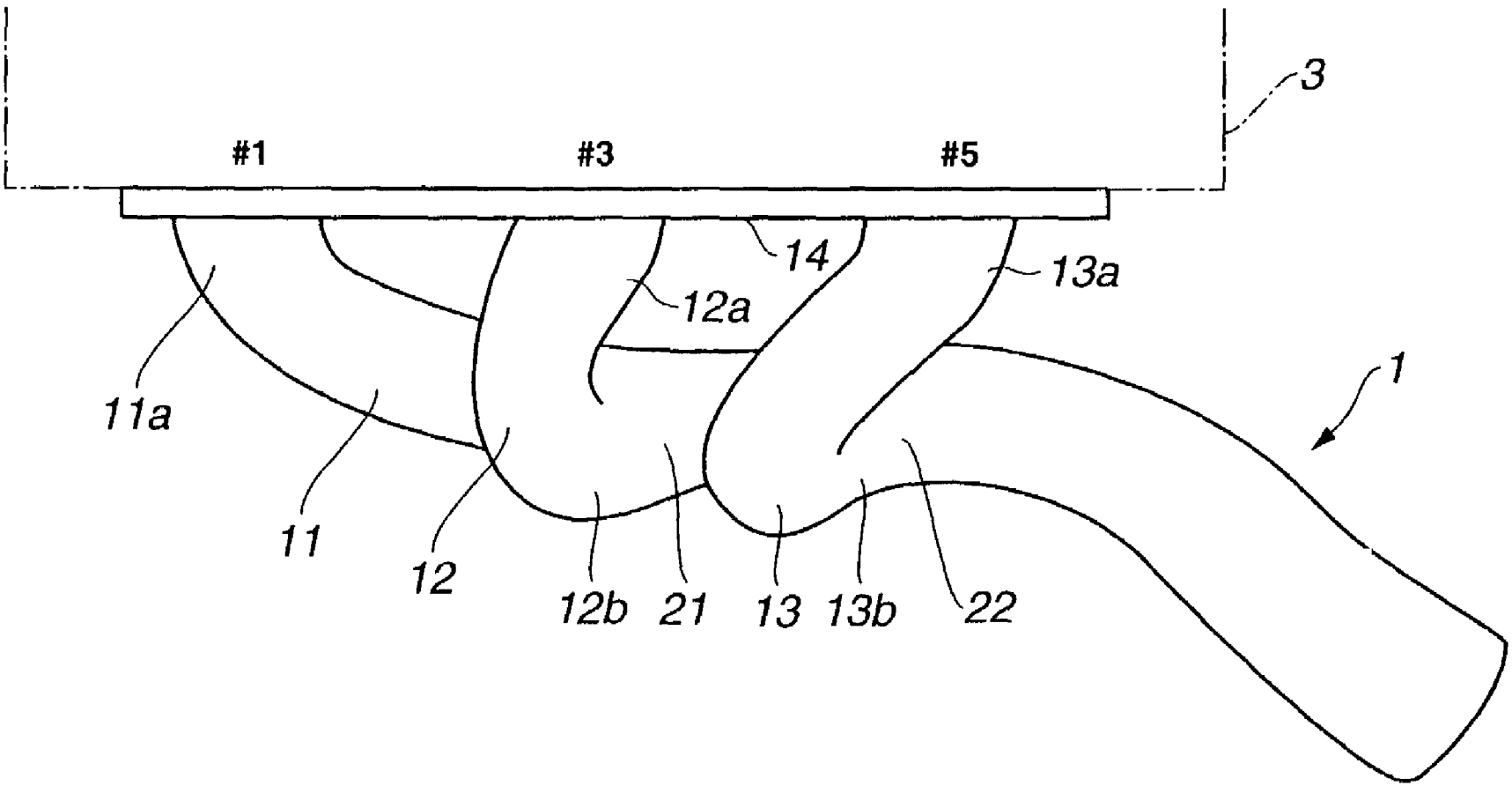
FIG. 1 is a plan view of an exhaust manifold according to a first embodiment of the present invention, as viewed from an upward position of an internal combustion engine.
Figure 2:
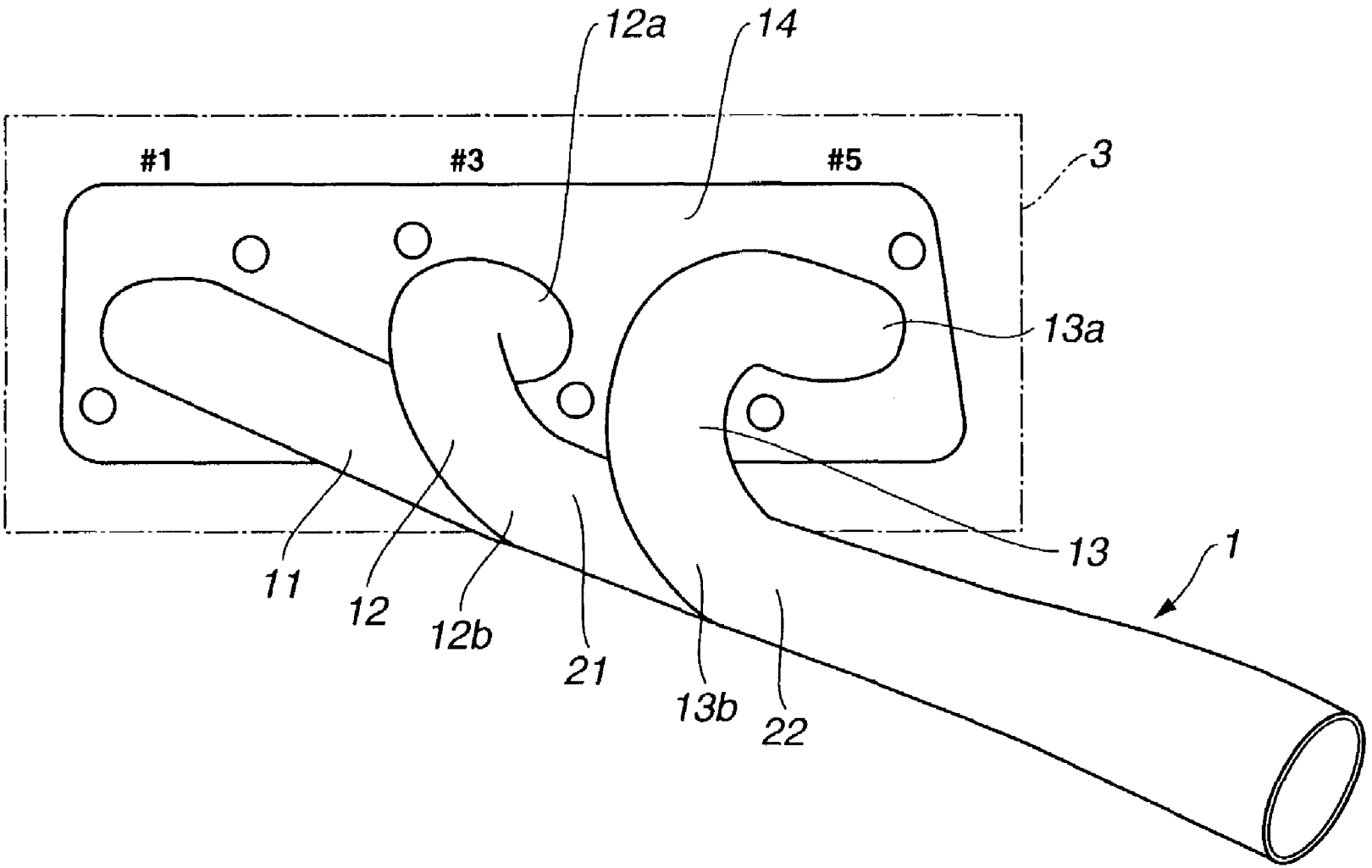
FIG. 2 is a bottom view of the exhaust manifold as viewed from a sideward position of the engine.
Figure 3:
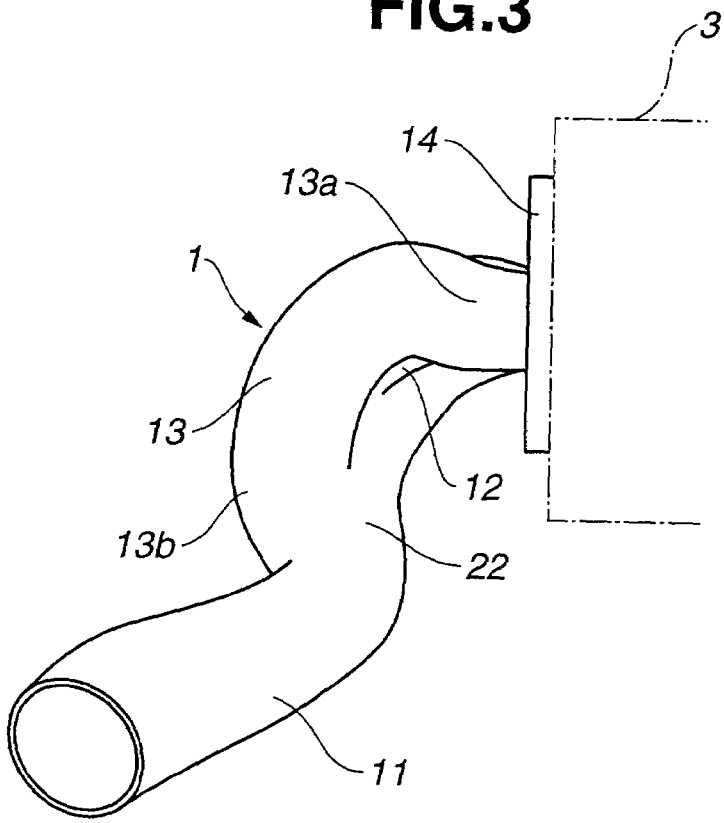
FIG. 3 is a side view of the exhaust manifold.
Figure 4:
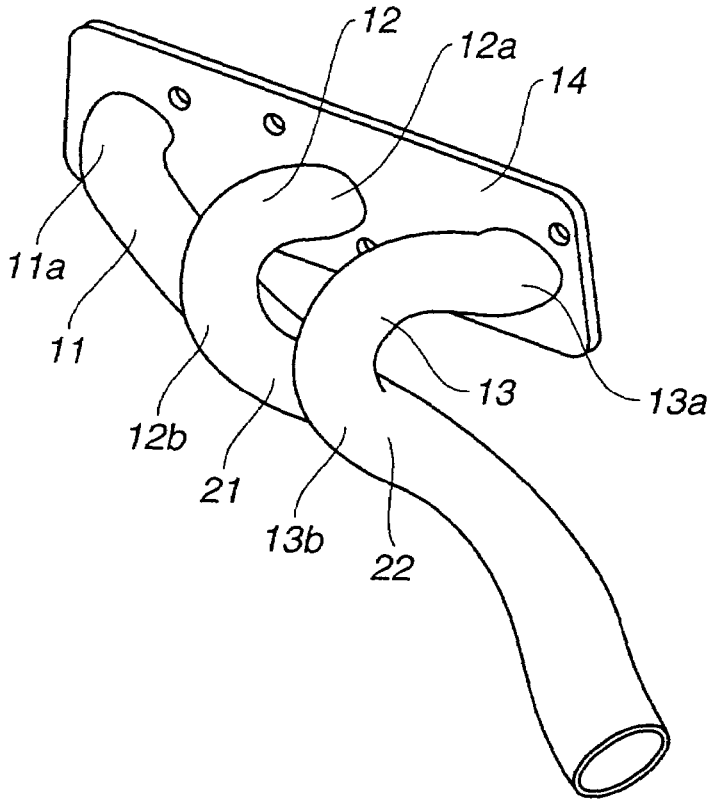
FIG. 4 is a perspective view of the exhaust manifold.
Figure 5:
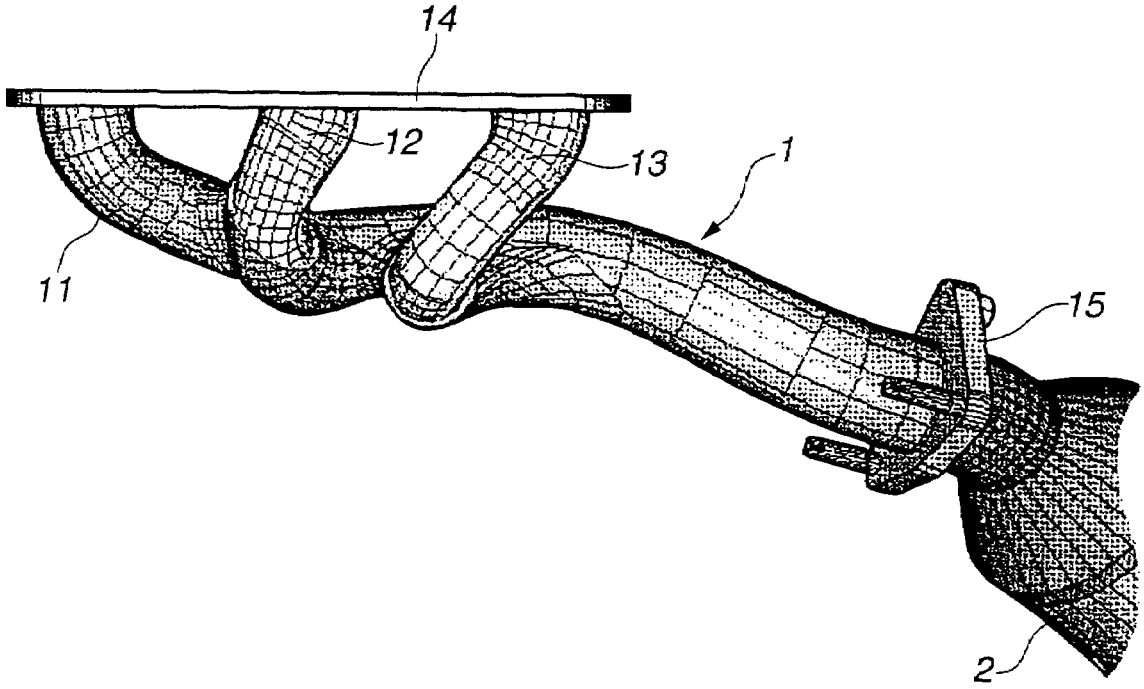
FIG. 5 is a reference view three-dimensionally representing a surface of the exhaust manifold using fine lines, and corresponding to FIG. 1.
Figure 6:
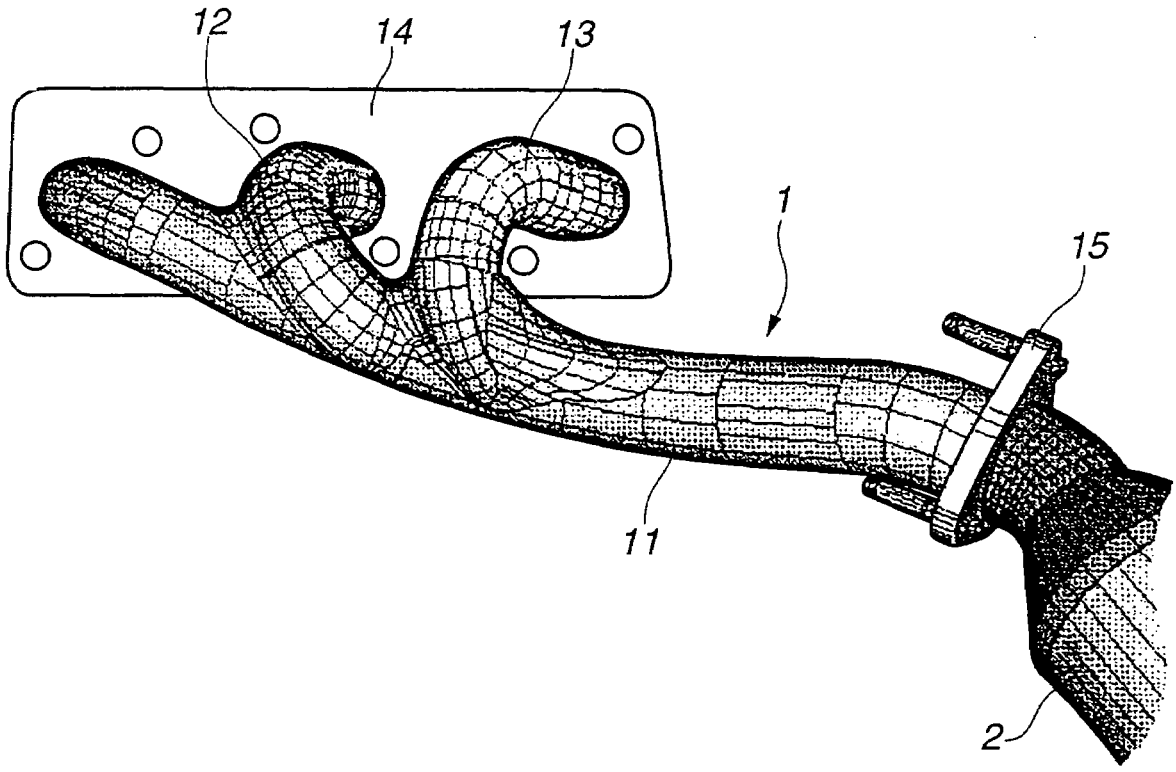
FIG. 6 is a reference view three-dimensionally representing a surface of the exhaust manifold using fine lines, and corresponding to FIG. 3.
Figure 7:
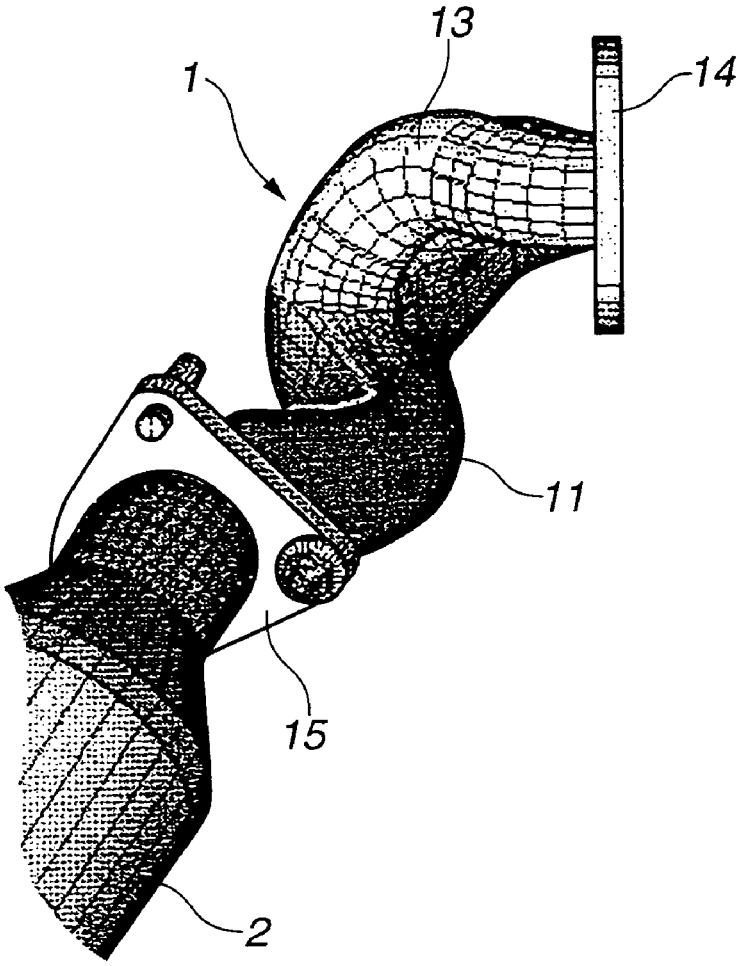
FIG. 7 is a reference view three-dimensionally representing a surface of the exhaust manifold using fine lines, and corresponding to FIG. 3.

Referring to FIGS. 1 through 7 there is shown a first embodiment of an exhaust manifold 1 for collecting exhaust passages of one bank of a V-type 6-cylinder engine (V-6 engine) into one passage, in accordance with the present invention. Exhaust manifold 1 is arranged to collect three exhaust passages for three cylinders #1, #3 and #5 provided at one bank of a cylinder head 3 of the V-6 engine into one passage connected to a catalytic converter 2. FIG. 1 is a plan view of exhaust manifold 1 as viewed from an upward position of the V-6 engine. FIG. 2 is a bottom view of exhaust manifold 1 as viewed from a sideward position of the V-6 engine. FIG. 3 is a side view of exhaust manifold 1 as viewed from a rearward position of the V-6 engine. FIG. 4 is a perspective view of exhaust manifold 1 as viewed from an obliquely rearward and upward position of the V-6 engine. FIGS. 5 through 7 are reference views three-dimensionally representing a surface of exhaust manifold 1 using fine lines, and correspond to FIGS. 1 through 3, respectively.

Exhaust manifold 1 comprises a primary exhaust pipe 11 which extends from an exhaust port of first cylinder #1 to rearward of the engine along the direction of a cylinder train of the straightly arranged cylinders #1, #3 and #5, a third-cylinder branch portion (pipe) 12 corresponding to a secondary exhaust pipe connected to the exhaust port of third cylinder #3, a fifth-cylinder branch portion (pipe) 13 corresponding to the secondary exhaust pipe connected to the exhaust port of fifth cylinder #5, and an installation flange 14 for connecting exhaust manifold 1 with a side surface of cylinder head 3.

An upstream end of primary exhaust pipe 11 is connected to installation flange 14, and a downstream end of primary exhaust pipe 11 is connected to a converter installation flange 15 as shown in FIGS. 5 through 7. An upstream end portion 11*a* connected to installation flange 14 is curved to form an L-shape. Primary exhaust pipe 11 including the end portion 11*a* then extends to catalytic converter 2 so as to substantially connect first cylinder #1 and catalytic converter 2 straight-likely in the shortest distance. More specifically, primary exhaust pipe 11 extends to an obliquely downward direction as shown in FIG. 2 since catalytic converter 2 is located at a lower position as compared with a position of a cylinder head 3. Although the drawings for the first embodiment show that primary exhaust pipe 11 is bent slightly inwardly in an area from a longitudinally central portion to a downstream side as shown in FIG. 1, the inward bending is suppressed at the required minimum.

An upstream end of third-cylinder branch portion 12 is connected to installation flange 14, and a downstream end of third-cylinder branch portion 12 is connected to first exhaust pipe 11 at a first collecting portion 21. Third-cylinder branch portion 12 is almost formed into a C-shape or U-shaped. An upstream portion 12*a* of third-cylinder branch portion 12 is curved so as to extend toward an upstream and upside direction of first exhaust pipe 11. Then, third-cylinder branch portion 12 is further curved from a crossover with first exhaust pipe 11 downwardly so as to extend toward a downstream side of primary exhaust pipe 11. Further, a downstream portion 12*b* of third-cylinder branch portion 12 spirally winds around an outer periphery of primary exhaust pipe 11 and is obliquely collected to primary exhaust pipe 11. That is, third-cylinder branch portion 12 is formed into a shape of winding into a center of primary exhaust pipe 11.

An upstream end of fifth-cylinder branch portion 13 is connected to installation flange 14, and a downstream end of fifth-cylinder branch portion 13 is connected to primary exhaust pipe 11 at a second collecting portion 22 which is located downstream of first collecting portion 21. Fifth-cylinder branch portion 13 is also formed into almost C-shape or U-shaped, as is similar to that of third-cylinder branch portion 12. An upstream portion 13*a* of fifth-cylinder branch portion 13 is curved so as to extend toward an upstream and upside of primary exhaust pipe 11. More specifically, the degree of the bending toward the extending direction of upstream portion 13*a* is greater than that of upstream portion 12*a* of third-cylinder branch portion 12 so as to largely change the extending direction toward the upstream and upside extending direction. Then, fifth-cylinder branch portion 13 is further curved from a crossover with primary exhaust pipe 11 downwardly so as to extend toward the downstream side of primary exhaust pipe 11. Further, a downstream portion 13*b* of fifth-cylinder branch portion 13 spirally winds around the outer periphery of primary exhaust pipe 11 and is obliquely collected to primary exhaust pipe 11. That is, fifth-cylinder branch portion 13 is formed into a shape of winding into a center of primary exhaust pipe 11, as is similar that third-cylinder 12 is formed.

At a first collecting portion 21 of primary exhaust pipe 11 and third-cylinder branch portion 12, a center axis of the downstream end of third-cylinder branch portion 12 obliquely crosses with a center axis of primary exhaust pipe 11. Similarly, at second collecting portion 22 of primary exhaust pipe 11 and fifth-cylinder branch portion 13, a center axis of the downstream end of fifth-cylinder branch portion 13 obliquely crosses with a center axis of primary exhaust pipe 11. That is, third-cylinder branch portion 12 and fifth-cylinder branch portion 13 are collected to primary exhaust pipe 11 from the oblique direction along a flow of exhaust gas in primary exhaust pipe 11. In the drawings for the first embodiment, both confluence angles α of the center axes with respect to the center axis of primary exhaust pipe 11 are represented to be smaller than or equal to 30°. The definition of confluence angle α is represented in FIG. 9.

A pipe length of fifth-cylinder branch portion 13 is longer than that of third-cylinder branch portion 12, and fifth-cylinder branch portion 13 winds around the outer periphery of primary exhaust pipe 11 with a larger angular range which is greater than that of third-cylinder branch portion 12. With reference to FIGS. 9 and 10, there is discussed these angular ranges hereinafter.

Figure 9:
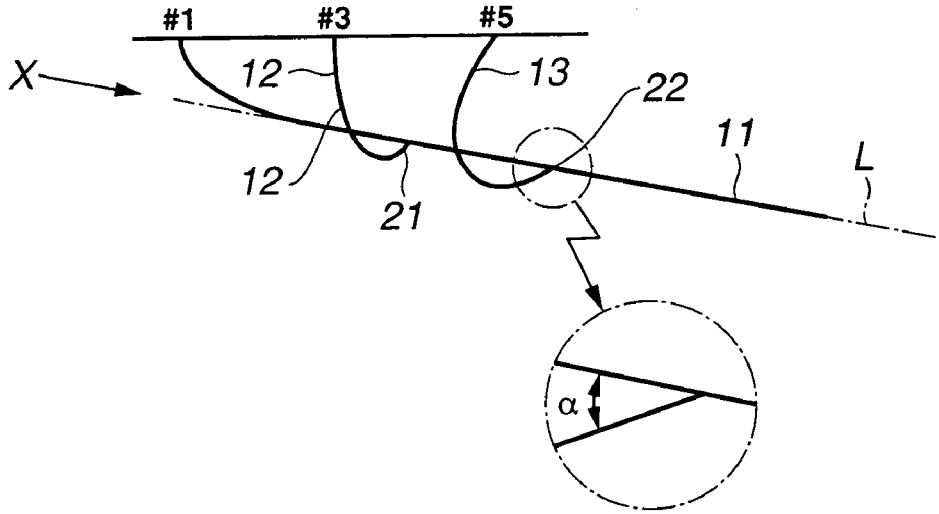
FIG. 9 is a simplified structural view of the exhaust manifold.
Figure 10:
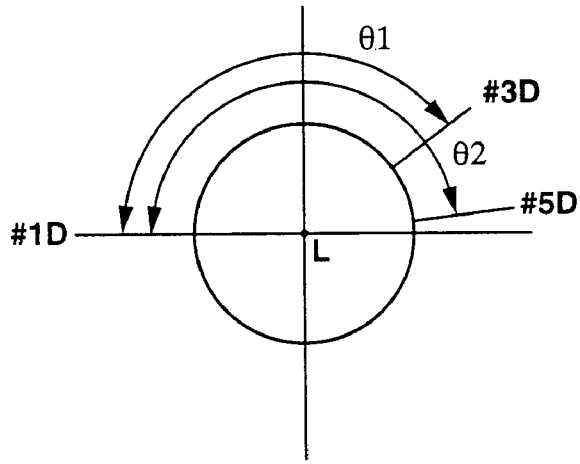
FIG. 10 is a projection view as viewed along the arrow X in FIG. 9.

FIG. 9 shows a simplified structural view of exhaust manifold 1. As discussed above, third-cylinder and fifth-cylinder branch portions 12 and 13 functioning as secondary exhaust pipes are formed so as to wind around the axis of primary exhaust pipe 11. Although upstream portion 11*a* is formed into an L-shape, a part of primary exhaust pipe 11 which includes first and second collecting portions 21 and 22 is almost straight. A center axis of this part of primary exhaust pipe 11 is herein defined as a reference center axis L.

FIG. 10 shows a projection of the reference center axis L as viewed from a front side of the engine, more specifically, a view as viewed along the direction of the arrow X in FIG. 9. On this projection, there are represented a first-cylinder passage extending direction along which end portion 11*a* of primary exhaust pipe 11 extends from the reference center axis L to the installation flange 14, a third-cylinder passage extending direction of an axis at a collecting portion of the downstream end of third-cylinder branch portion 12, and a fifth-cylinder passage extending direction #5D of an axis at a collecting portion of the downstream end of fifth-cylinder branch portion 13, by references #1D, #3D and #5D, respectively. A turn angle θ1 from first-cylinder passage extending direction #1 to third-cylinder passage extending direction #3 is different from a turn angle θ2 from first-cylinder passage extending direction #1 to fifth-cylinder passage extending direction #5, and turn angle θ2 is greater than angle θ1 as shown in FIG. 10. These turn angles θ1 and θ2 correspond to turn angles of first and second branch portions 12 and 13 relative to primary exhaust pipe 11, respectively.

Due to this difference between turn angles θ1 and θ2, third-cylinder branch portion 12 and fifth-cylinder branch portion 13 are connected at angularly offset positions of the outer periphery of primary exhaust pipe 11. Therefore, even if the confluence angles α are set smaller than 30°, there is caused no interference between third-cylinder and fifth-cylinder branch portions 12 and 13. In other words, it becomes possible to approach first and second collection portions 21 and 22 in the longitudinal direction of primary exhaust pipe 11. This arrangement of exhaust manifold 1 according to the present invention is advantageous to a shortening of a total length of exhaust manifold 1 and an equalization of exhaust pipe lengths for respective cylinders.

It is preferable that turn angle θ1 is set within a range from 90° to 180° and turn angle θ2 is set at an angle greater than turn angle θ1, in order to avoid the interference with cylinder head 3 and to sufficiently ensure the pipe length of third-cylinder branch portion 12. More specifically, in the first embodiment, turn angle θ1 is set within a range from 150° to 170°, and turn angle θ2 is set within a range from 170° to 190°.

Figure 8:
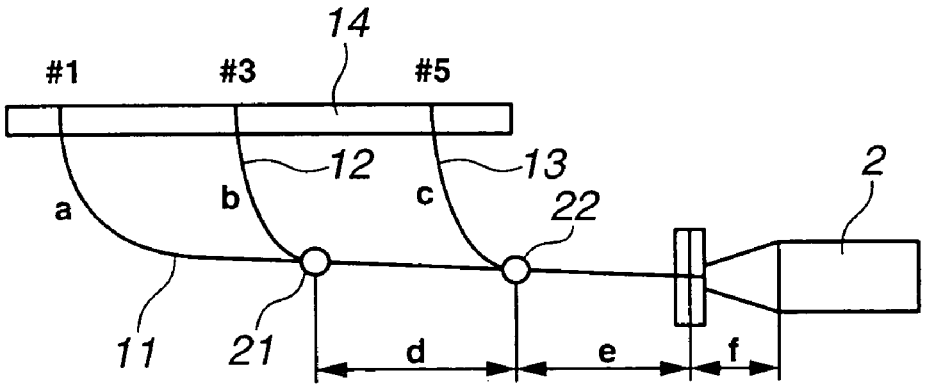
FIG. 8 is an explanatory view explaining a concept as to a pipe length of the exhaust manifold.

With reference to FIG. 8, there is discussed a concept of a pipe length of exhaust manifold 1 which is arranged to collect three exhaust lines of three cylinders into one line. It may be considered that exhaust manifold 1 is constructed by pipes having lengths a through e as shown in FIG. 8. Further, it may be considered that a space portion upstream of a catalyst in a casing of catalytic converter 2 corresponds to a length f in FIG. 8 and is a part of the total pipe length to catalyst. A pipe length for first cylinder #1, which is farthest from catalytic converter 2, is a+d+e+f. From the viewpoint of evaluating a temperature rising characteristic of catalytic converter 2 connected to three cylinders #1, #3 and #5, a total length of passages for three cylinders #1, #3 and #5 is employed. That is, the total length of all passages is a+b+c+d+e+f. It is preferable to shorten the total length as possible from the viewpoint of a quick activation of catalytic converter 2. Exhaust manifold 1 of the first embodiment is constructed on the presumption that it is adapted to an internal combustion engine having a total displacement of 2500 cc through 3000 cc. With the first embodiment according to the present invention, it is possible to set the total length of exhaust manifold 1 within 900 mm so as to quickly rise the temperature of catalytic converter 2 after starting the engine.

A first-cylinder pipe length from the exhaust port of first cylinder #1 to second collecting portion 22 is a+d, a third-cylinder pipe length from the exhaust port of third cylinder #3 to second collecting portion 22 is b+d, and a fifth-cylinder pipe length from the exhaust port of fifth cylinder #5 to second collecting portion 22 is c. With the first embodiment according to the present invention, it is possible to decrease a difference between the longest pipe length and the shortest pipe length to 50 mm or less. Accordingly, it is possible to sufficiently equalize the pipe lengths of first, third and fifth cylinders #1, #3 and #5 and to improve the sound quality of exhaust sound.

With exhaust manifold 1 of the first embodiment according to the present invention, it becomes possible to improve the temperature rising characteristic of catalytic converter 2 by sufficiently shortening the total pipe length of exhaust manifold 2. Simultaneously, it becomes possible to improve the exhaust sound of exhaust manifold 1 by equalizing the pipe lengths for the respective cylinders. Further, exhaust manifold 1 is capable of setting the confluence angles α small, and therefore it becomes possible to decrease the air flow resistance of exhaust manifold 1, to improve the volumetric efficiency during high-speed driving, and to improve the exhaust interference during middle-speed driving.

From the viewpoint of decreasing the air flow resistance of an exhaust manifold, it is generally preferable to satisfy a condition of $R/D \geqq 1.1$ where D is a diameter of a passage, and R is a radius of curvature at a bent portion of the passage. Since exhaust manifold 1 according to the present invention does not have a bent portion including an extremely small radius of curvature, exhaust manifold 1 according to the present invention easily satisfies the above condition of $R/D \geqq 1.1$.

Figure 11:
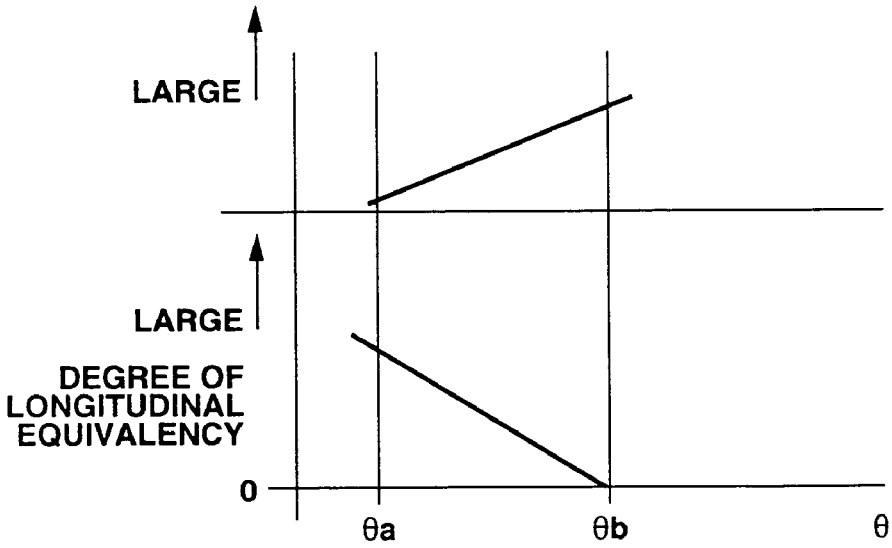
FIG. 11 is a graph showing a relationship among a turn angle θ, a confluence angle α and a pipe length equivalency.

FIG. 11 shows a relationship among turn angles θ1 and θ2 of third-cylinder and fifth-cylinder branch portions 12 and 13, confluence angle α and the degree of pipe-length equivalency, which relates to the differences of the pipe lengths for first, third and fifth cylinders #1, #3 and #5. Herein, turn angles θ1 and θ2 are call turn angle θ. As shown in FIG. 11, the difference of the pipe lengths approaches 0 as turn angle θ increases, and the difference increases as turn angle θ decreases. From the viewpoint of the pipe length equivalency, a lower limit θa of turn angle θ is determined. On the other hand, under a condition that the pipe lengths of third-cylinder branch portion 12 and fifth-cylinder branch portion 13 are constant, there is a tendency that confluence angle α increases as turn angle θ increases. From the viewpoint of confluence angle α, an upper limit θb of turn angle θ is determined. In order to satisfy confluence angle α and the pipe length equivalency, turn angles θ1 and θ2 are limited within a range from angle θa to angle θb.

Figure 12:
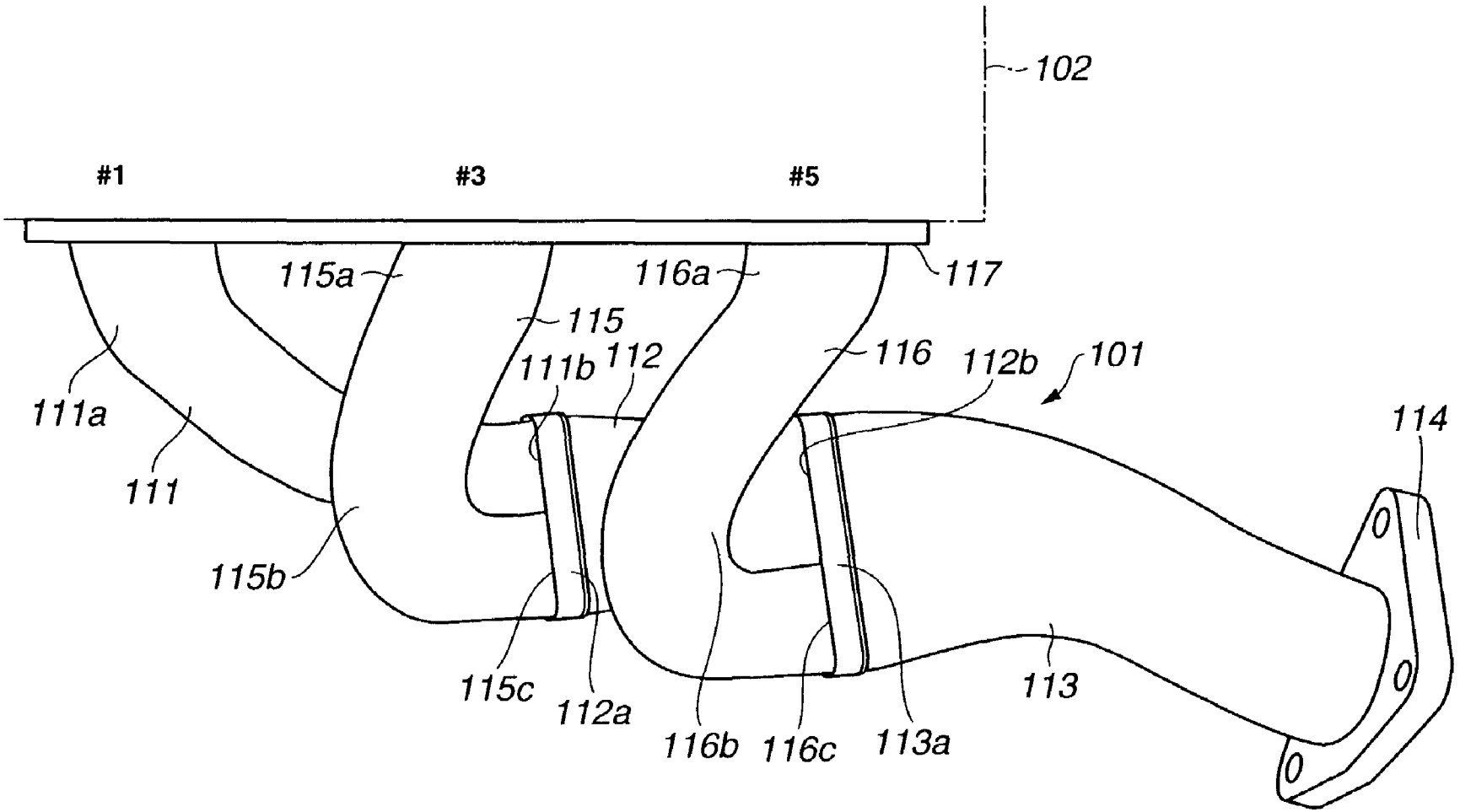
FIG. 12 is a plan view of the exhaust manifold according to a second embodiment of the present invention, as viewed from an upward position of an internal combustion engine.
Figure 13:
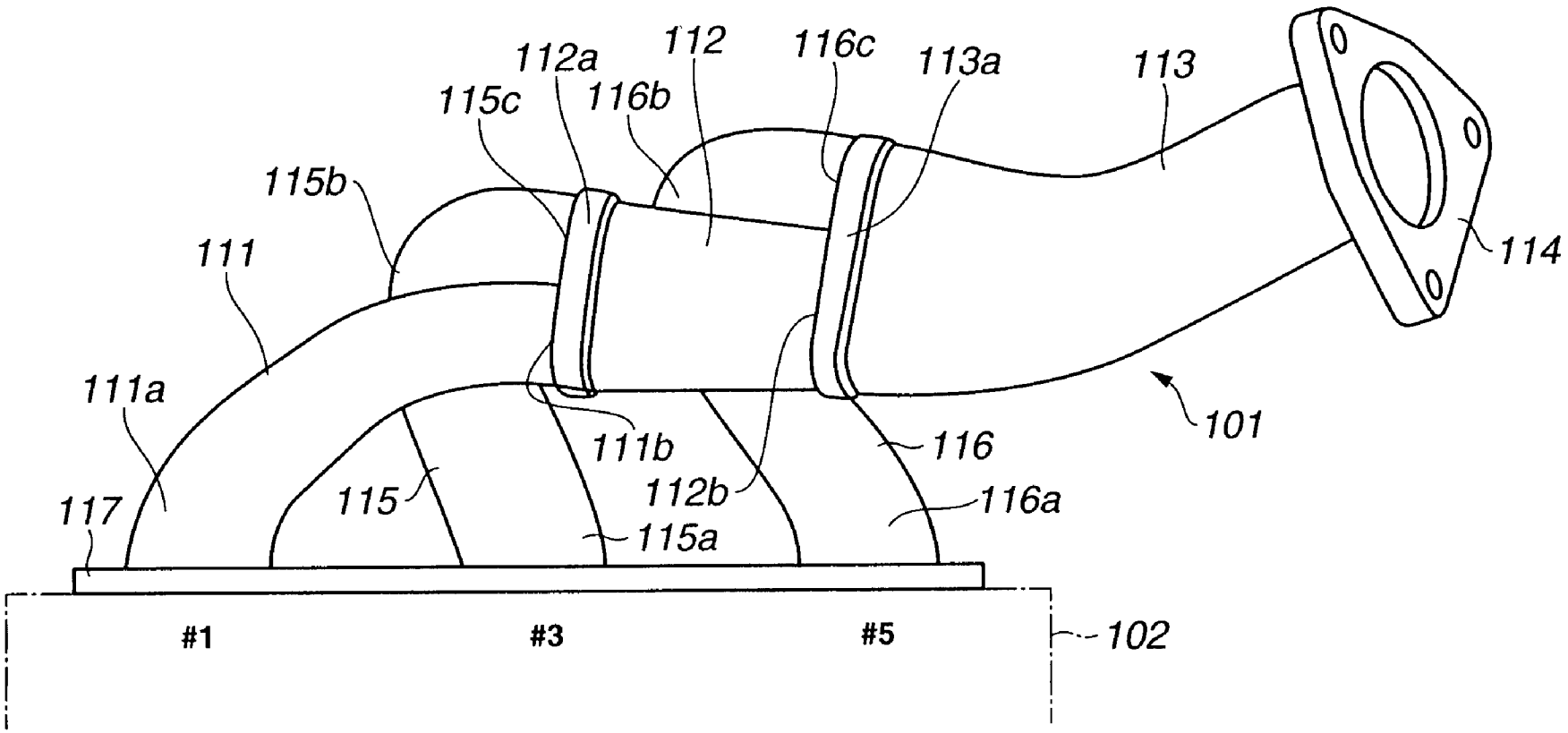
FIG. 13 is a bottom view of the exhaust manifold of FIG. 12
Figure 14:
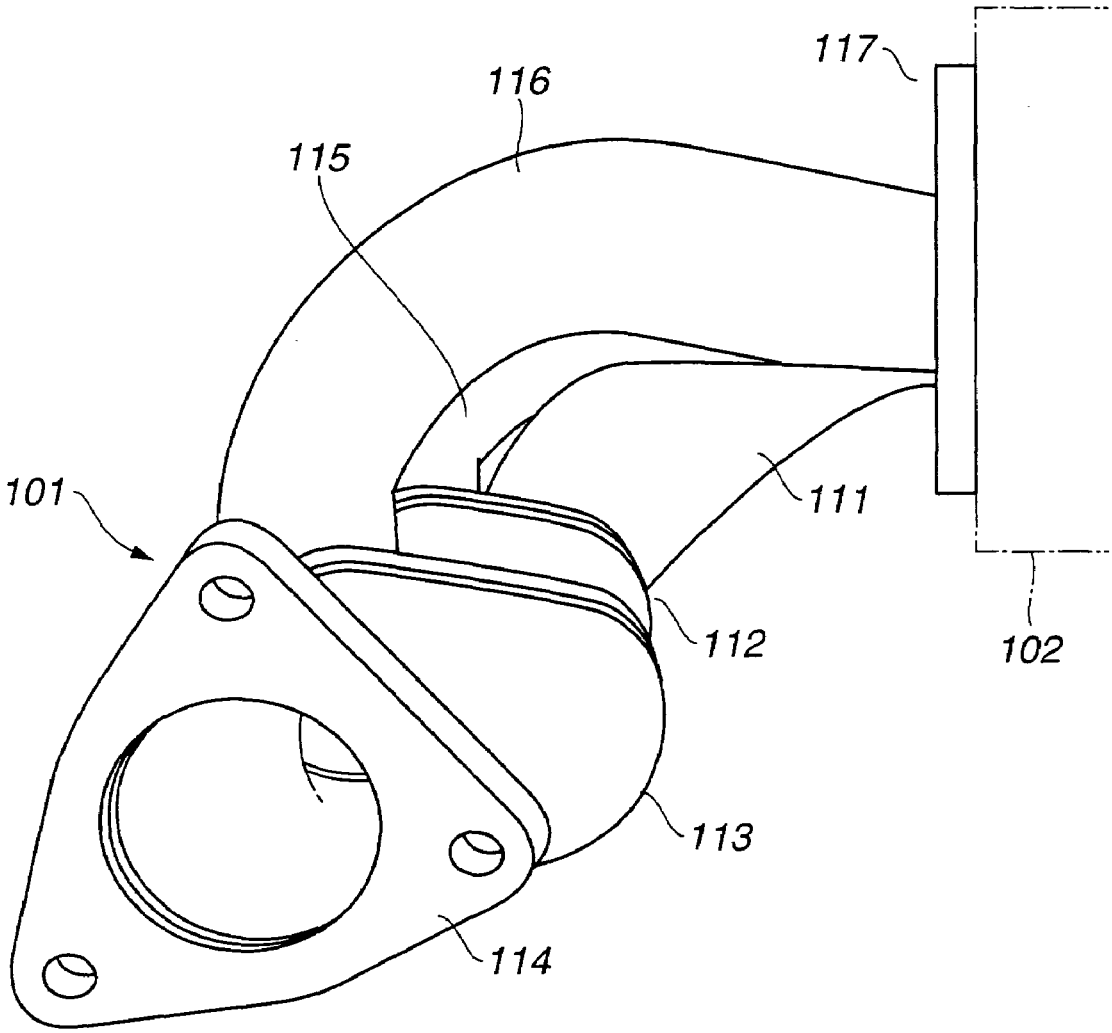
FIG. 14 is a side view of the exhaust manifold of FIG. 12 as viewed from a rearward direction of the internal combustion engine.
Figure 15:
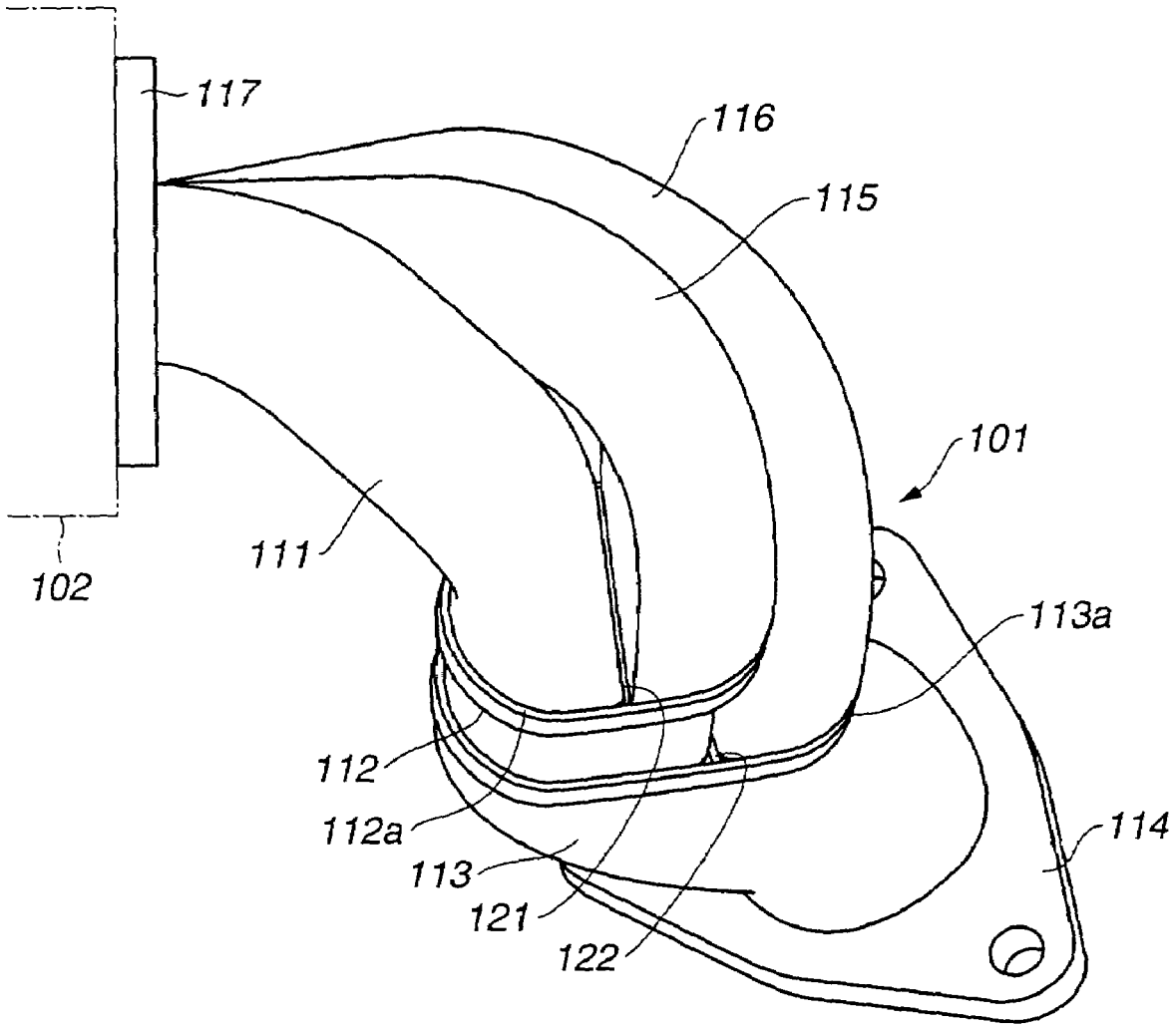
FIG. 15 is a side view of the exhaust manifold of FIG. 12 as viewed from a forward direction of the internal combustion engine.
Figure 16:
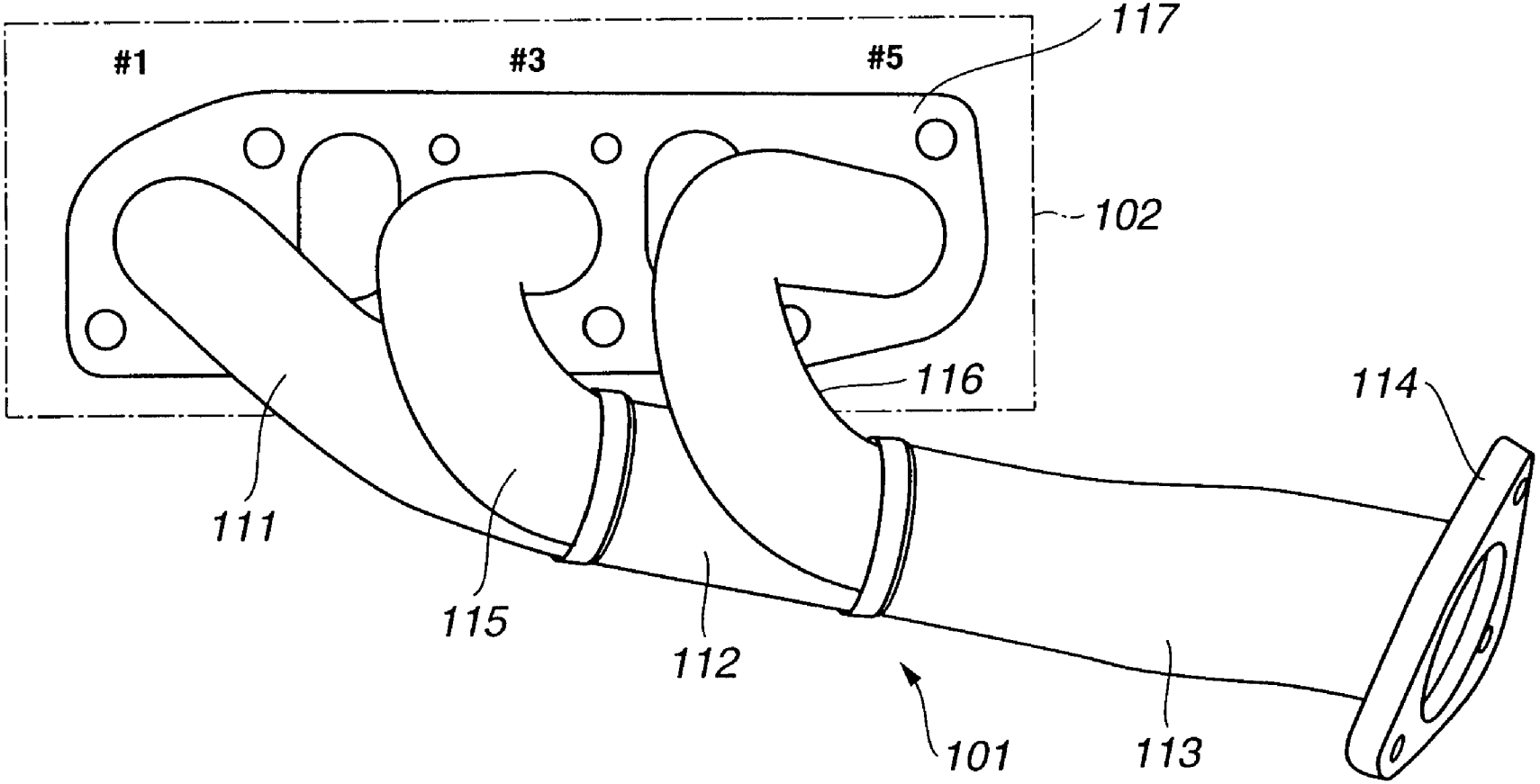
FIG. 16 is a front view of the exhaust manifold of FIG. 12 as viewed from the sideward direction of the internal combustion engine.
Figure 17:
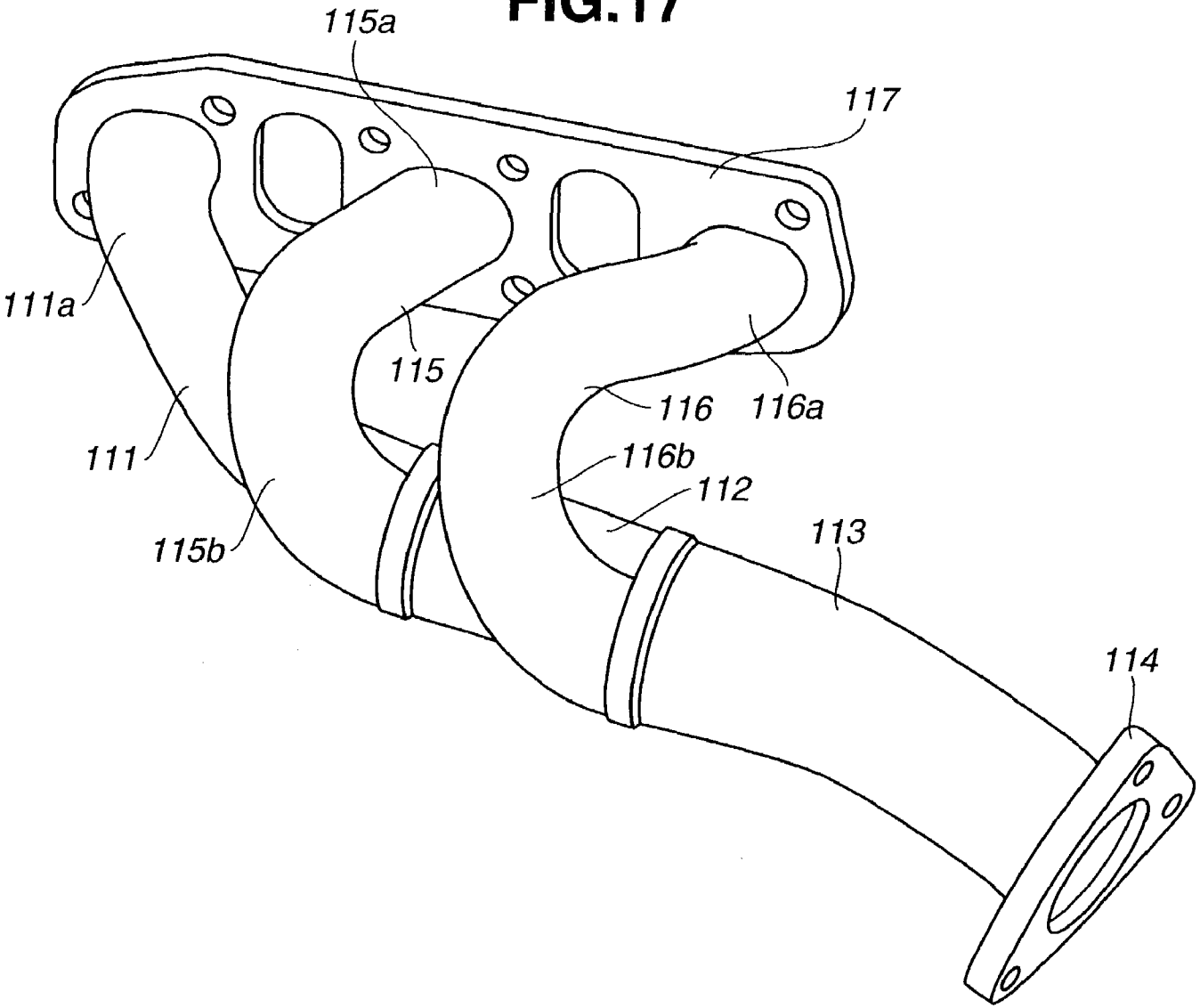
FIG. 17 is a perspective view of the exhaust manifold of FIG. 12 as viewed from the obliquely rearward and downward direction of the internal combustion engine.

Referring to FIGS. 12 through 17, there is shown a second embodiment of an exhaust manifold 101 for collecting exhaust ports of one bank of a V-6 engine, in accordance with the present invention. More specifically, three exhaust ports of three cylinders #1, #3 and #5 provided at one bank of a cylinder head 103 of the V-6 engine are collected into one passage connected to a catalytic converter (not shown). FIG. 12 is a plan view of exhaust manifold 101 as viewed from an upward position of the V-6 engine. FIG. 13 is a bottom view of exhaust manifold 101 as viewed from a downward position of the V-6 engine. FIG. 14 is a side view of exhaust manifold 101 as viewed from a rearward position of the V-6 engine. FIG. 15 is a side view of exhaust manifold 101 as viewed from a frontward position of the V-6 engine. FIG. 16 is a front view of exhaust manifold 101 as viewed from a sideward position of the V-6 engine. FIG. 17 is a perspective view of exhaust manifold 1 as viewed from an obliquely upward position of the V-6 engine.

Exhaust manifold 101 comprises a primary exhaust pipe (passage), and two secondary exhaust pipes (passages). The primary exhaust pipe extends from the exhaust port of first cylinder #1 to rearward of the engine while being along the direction of the arrangement of cylinders #1, #3 and #5. One of secondary exhaust pipes extends from the exhaust port of third cylinder #3 to the primary exhaust pipe and is connected to the primary exhaust pipe. The other of secondary exhaust pipes extends from the exhaust port of fifth cylinder #5 to the primary exhaust pipe and is connected to a downstream portion of the primary exhaust pipe as compared with the connecting portion of the secondary exhaust pipe of third cylinder #3.

More specifically, the primary exhaust pipe is constructed by a first-cylinder branch pipe 111 connected to the exhaust port of first cylinder #1, an intermediate pipe 112 forming a first voluminous portion, and an outlet pipe 113 forming a second voluminous portion and including a flange 114. The secondary exhaust pipe of third cylinder #3 is constructed by a third-cylinder branch pipe 115 connected to the exhaust portion for third cylinder #3. The secondary exhaust pipe for fifth cylinder #5 is constructed by a fifth-cylinder branch pipe 116 connected to the exhaust portion of fifth cylinder #5. Flange 114 of outlet pipe 113 is connected to a pipe including the catalytic converter.

Figure 26:
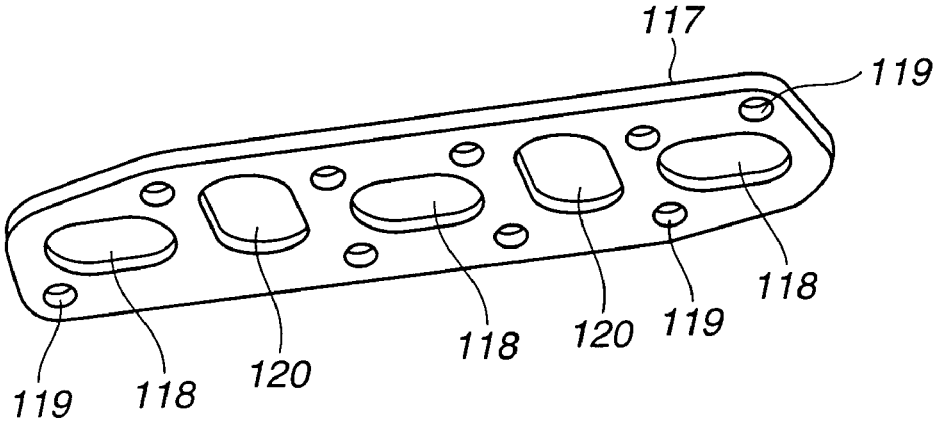
FIG. 26 is a perspective view of an installation flange shown in FIG. 12.

An installation flange 117 for connecting exhaust manifold 101 to a side surface of cylinder head 2 is welded to upstream ends of the respective branch pipes 111, 115 and 116. FIG. 26 is a perspective view showing the installation flange 117 alone. As shown in FIG. 26, installation flange 117 is a flat plate which has three oval openings 18 for exhaust ports of the respective cylinders #1, #3 and #5, two weight-reduction opening 20 formed between oval openings 18 and a plurality of small holes 19 through which a plurality of bolts are inserted and tightened to fix installation flange 117 on cylinder head 102. Three oval openings 18 are elongated in the fore-and-aft direction of the engine, and weight-reduction openings 19 are elongated in the vertical direction of the engine. Upstream ends of branch pipes 111, 115 and 116 are inserted into three openings 18, respectively and are fixedly welded to installation flange 117.

The primary exhaust pipe constructed by first branch pipe 111, intermediate pipe 112 and outlet pipe 113 is bent at its upstream end to form an L-shape, and then extends from the exhaust port of first cylinder #1 to flange 114 connected to a front tube of the catalytic converter so as to extend substantially straight in the shortest distance. More specifically, first exhaust pipe 2 extends to an obliquely downward direction as shown in FIG. 16 since the front tube extends to an under floor of the vehicle. Although the drawings for the second embodiment show that outlet pipe 113 is bent slightly and inwardly in an area from a longitudinally central portion to a downstream side as shown in FIGS. 12 and 17 due to the restrictions on the relationship with other parts on the vehicle, the inward bending is suppressed at the required minimum.

Figure 27:
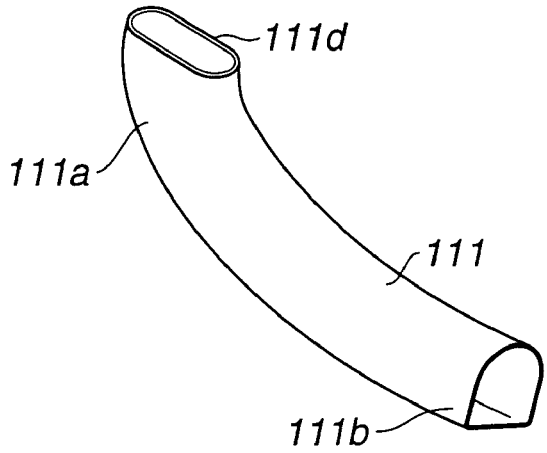
FIG. 27 is a perspective view of the first-cylinder branch pipe.

Each of first-cylinder, third-cylinder and fifth-cylinder branch pipes 111, 115 and 116 is formed into a predetermined shape having a specific bent portion and specific cross-section by machining a metal pipe by means of hydraulic forming or the like. The upstream end portion of first-cylinder branch pipe 111 protrudes from installation flange 117 to the obliquely rearward direction. FIG. 27 is a perspective view of first-cylinder branch pipe 111 alone. An upstream end 111*d* of first-cylinder branch pipe 111, which is connected to installation flange 117, has a oval cross section corresponding to opening 118. A downstream end portion 111*b* has a D-shaped cross section.

Intermediate pipe 112 is formed into a short cylinder which gradually decreases the diameter from an upstream side to a downstream side and which has an oval inlet portion 112*a* and a D-shaped outlet portion 112*b*. A downstream end portion 111*b* of first-cylinder branch pipe 111 is straightly connected and welded to inlet portion 112*a* of intermediate portion 112, particularly at a side near cylinder head 2 in the inlet portion 112*a* as viewed from a top of cylinder head 2. Outlet pipe 113 is formed into a cylinder shape which has an oval inlet portion 113*a* and a circular outlet connected to front-tube connecting flange 114 and which gradually changes its cross section from a compressed circle (oval) to a circle. Outlet portion 112*b* of intermediate pipe 112 is straightly connected and welded to inlet portion 113*a* of outlet pipe 113, particularly at a side near cylinder head 2 as viewed from a top of cylinder head 2. An end of outlet portion 112*b* of intermediate pipe 112, which is connected to inlet portion 113*a* of outlet pipe 113, is formed into a D-shaped cross section.

Figure 28:
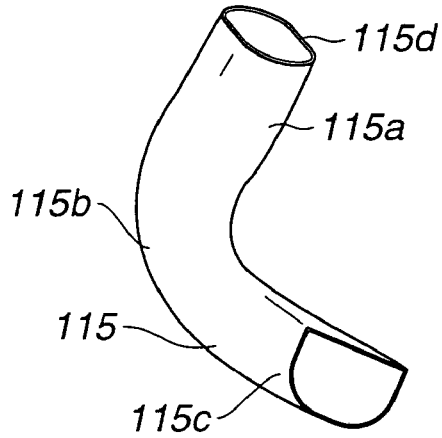
FIG. 28 is a perspective view of the third-cylinder branch pipe.

In contrast to this, third-cylinder branch pipe 115 is formed into a bent shape of a C-shape or U-shape. More specifically, upstream portion 115*a* connected to installation flange 117 projects from installation flange 117 toward upward and obliquely forward direction with respect to the engine. An intermediate portion 115*b* of third-cylinder branch pipe 115 crosses over first-cylinder branch pipe 111 and is bent downwardly so as to wind around the outer periphery of first-cylinder branch pipe 111. Then, third-cylinder branch pipe 115 is bent downwardly and toward the downstream direction. A downstream end portion 115C of third-cylinder branch pipe 115 is located side by side with downstream end portion 111*b* of first-cylinder branch pipe 111. Downstream end portion 115*c* is straightly connected and welded to inlet portion 112*a* of intermediate pipe 112, particularly at a side apart from cylinder head 2 as viewed from a top of cylinder head 2. That is, third-cylinder branch pipe 115 functioning as a secondary exhaust pipe extends from the outlet portion of third cylinder #3 so as to wind into a center of first-cylinder branch pipe 111 and is collected with an engine far side of the first-cylinder branch pipe 111 functioning as the primary exhaust pipe. Herein, the pipe length of third-cylinder branch pipe 115 is set to be equal to the pipe length of first-cylinder branch pipe 111. FIG. 28 is a perspective view of third-cylinder branch pipe 115 alone. An upstream end 115*d* of third-cylinder branch pipe 115, which is connected to installation flange 117, has an oval cross section corresponding to opening 118, and a downstream end portion 115*c* of third-cylinder branch pipe 115 has a D-shaped cross section.

Figure 20:
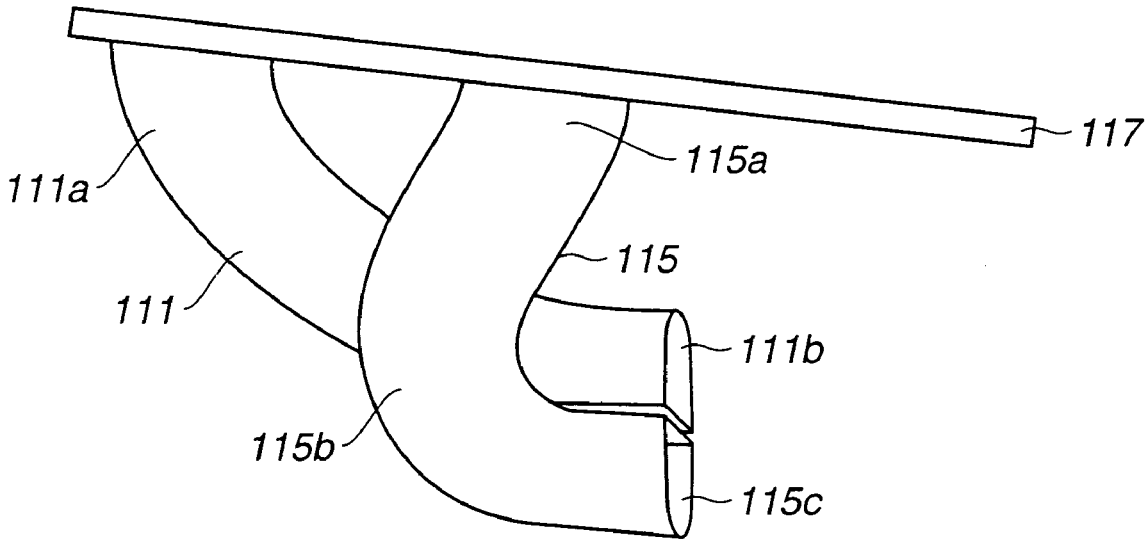
FIG. 20 is an exploded view showing the first-cylinder branch pipe and the third-cylinder branch pipe of the exhaust manifold of FIG. 12, from which the intermediate pipe is eliminated.
Figure 21:
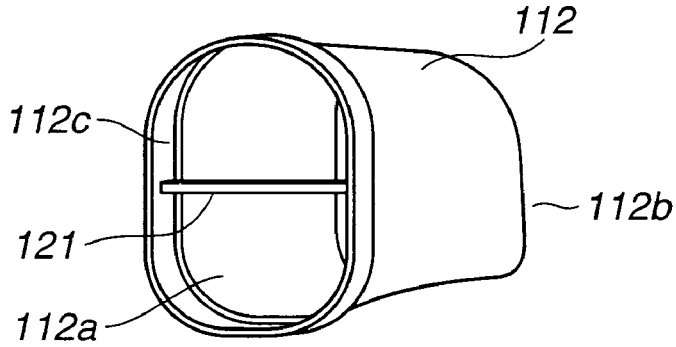
FIGS. 21 and 22 are perspective views showing inlet portion 112*a* and outlet portion 112*b* of intermediate pipe 112, respectively.
Figure 22:
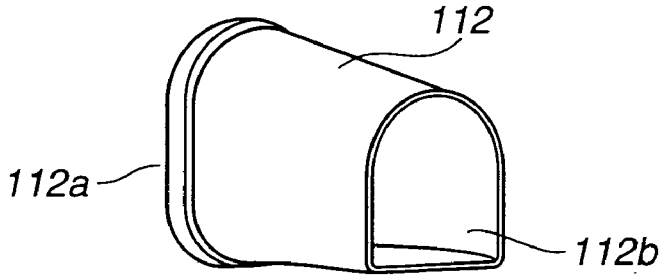

FIG. 20 is an exploded view showing first-cylinder branch pipe 111 and third-cylinder branch pipe 115 from which intermediate pipe is eliminated. FIGS. 21 and 22 are perspective views showing inlet portion 112*a* and outlet portion 112*b* of intermediate pipe 112, respectively. As shown in FIG. 21, a partition plate 121 is welded at a center portion of oval inlet portion 112*a* of intermediate pipe 112 so that inlet portion 112*a* is partitioned into a θ-shape portion constructed by two D-shaped openings. Downstream end portion 111*b* of first-cylinder branch pipe 111 is inserted into one D-shape opening of inlet portion 112*a* and is welded thereto. Further, downstream end portion 115*b* of third-cylinder branch pipe 115 is inserted into the other D-shape opening of inlet portion 112*a* and is welded thereto. An end periphery of inlet portion 112*a* is formed into an engaged portion 112*c* such that a diameter of the engaged portion 112*c* is increased stepwise as compared with the diameter of the following portion of inlet portion 112*a*. By this arrangement, downstream end portions 111*b* and 115*b* are engaged with an inner surface of engaged portion 112*c* so as to achieve the positioning thereof in the axial direction.

Figure 29:
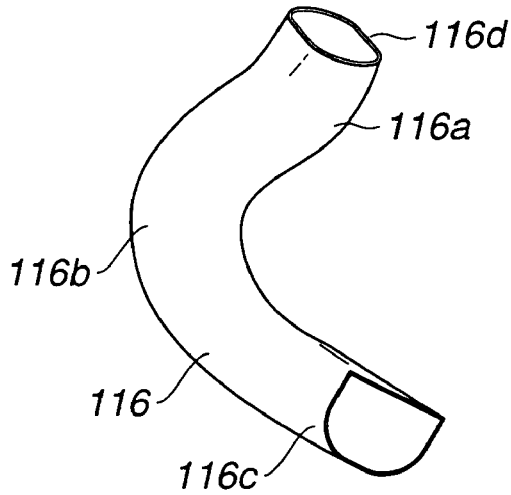
FIG. 29 is a perspective view of the fifth-cylinder branch pipe.

Fifth-cylinder branch pipe 116 is also formed into a bent shape of a C-shape or U-shape. More specifically, upstream portion 116*a* connected to installation flange 117 projects from installation flange 117 toward the upward and obliquely forward direction with respect to the engine. An intermediate portion 116*b* of fifth-cylinder branch pipe 116 crosses over intermediate pipe 112 and is bent downwardly so as to wind around the outer periphery of intermediate pipe 112. Then, fifth-cylinder branch pipe 116 is bent downwardly and toward the downstream direction. A downstream end portion 116C of fifth-cylinder branch pipe 116 is located side by side with downstream end portion 112*b* of intermediate pipe 112. Downstream end portion 116*c* is straightly connected and welded to inlet portion 113*a* of outlet pipe 113, particularly at a side apart from cylinder head 2 as viewed from a top of cylinder head 2. That is, fifth-cylinder branch pipe 116 functioning as the secondary exhaust pipe extends from the outlet portion of fifth cylinder #5 so as to wind into a center of intermediate pipe 112 and is collected with an engine far side of intermediate pipe 112 functioning as the secondary exhaust pipe. Herein, fifth-cylinder branch pipe 116 is bent so as to largely project in the forward and upward direction as compared with third-cylinder pipe 115. Accordingly, the pipe length of fifth-cylinder branch pipe 116 is set to be longer than the pipe length of third-cylinder branch pipe 115. More specifically, the pipe length of fifth-cylinder branch pipe 116 is longer than the pipe length of third-cylinder branch pipe 115 by a pipe length of intermediate pipe 112. This arrangement substantially equalizes the pipe lengths of exhaust passages for first, third and fifth cylinders #1, #3 and #5 wherein each pipe length is a length from the exhaust port of each cylinder to front-tube connecting flange 114. From the viewpoint of the sound quality of exhaust sounds, it is preferable that a difference between the shortest pipe length and the longest pipe length is smaller than or equal to 50 mm. Therefore, exhaust manifold 101 of the second embodiment satisfies this requirement so as to preferably improve the sound quality of exhaust sound. FIG. 29 is a perspective view showing fifth-cylinder branch pipe 116 alone. An upstream end 116*d* of third-cylinder branch pipe 116, which is connected to installation flange 117, has an oval cross section corresponding to opening 118, and a downstream end portion 116*c* of fifth-cylinder branch pipe 116 has a D-shaped cross section.

Figure 18:
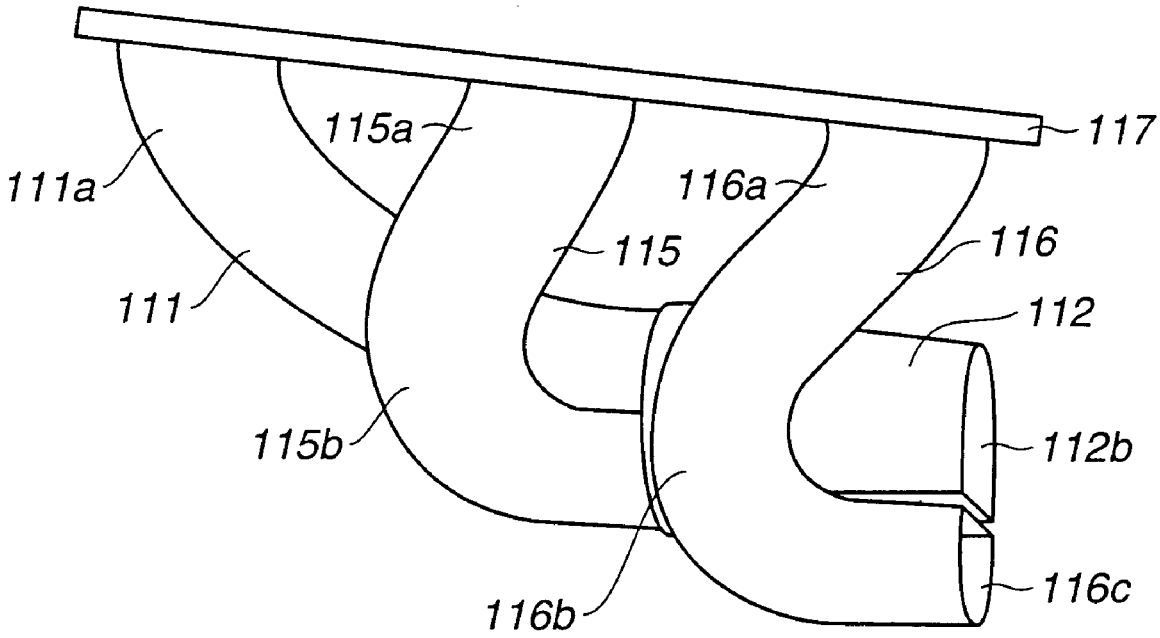
FIG. 18 is an exploded view showing an intermediate pipe and a fifth-cylinder branch pipe in addition to a first-cylinder branch pipe and a third-cylinder branch pipe of the exhaust manifold of FIG. 12, from which an outlet pipe is eliminated.
Figure 19:
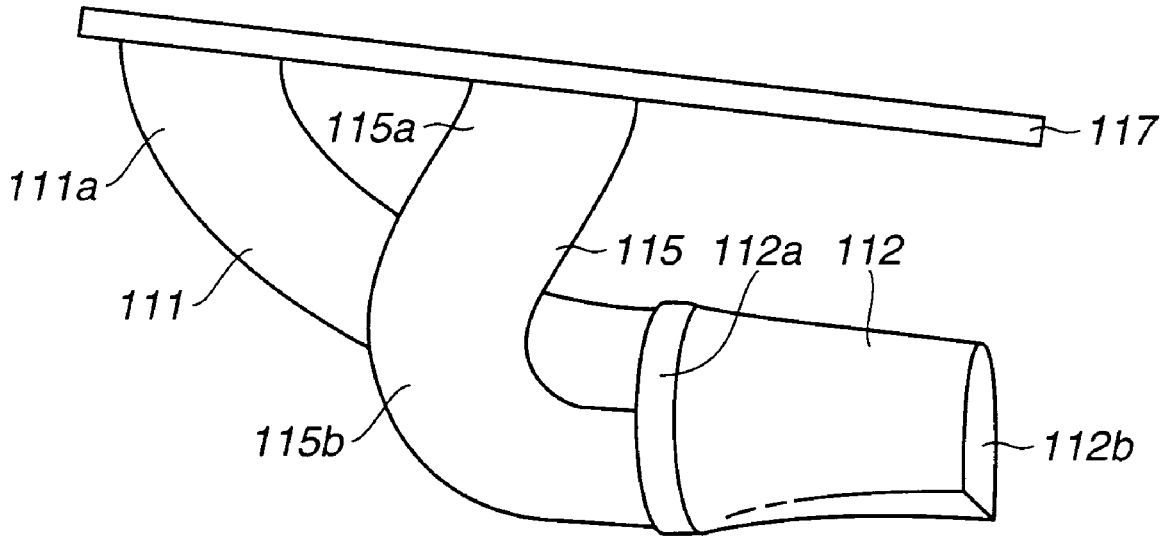
FIG. 19 is an exploded view showing the intermediate pipe in addition to the first-cylinder branch pipe and the third-cylinder branch pipe of the exhaust manifold of FIG. 12, from which the fifth-cylinder branch pipe is further eliminated.

FIG. 18 is an exploded view showing intermediate pipe 112 and fifth-cylinder branch pipe 116 in addition to first-cylinder branch pipe 111 and third-cylinder branch pipe 115, from which outlet pipe 113 is eliminated. FIG. 19 is an exploded view showing intermediate pipe 112 in addition to first-cylinder branch pipe 111 and third-cylinder branch pipe 115, from which fifth-cylinder branch pipe 116 is further eliminated.

Figure 23:
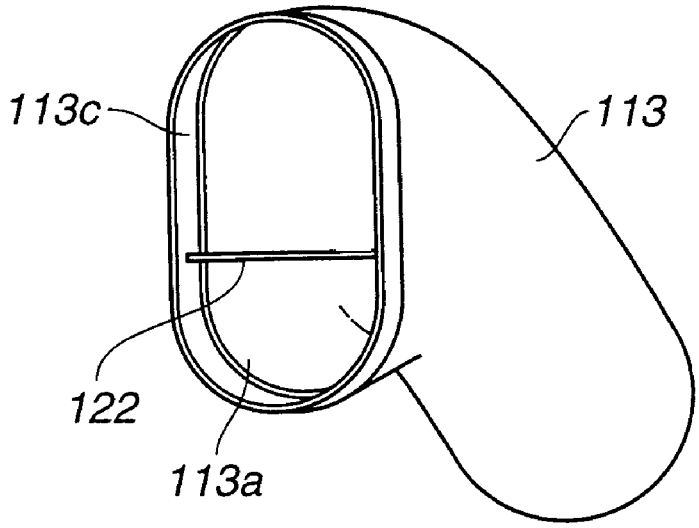
FIG. 23 is a perspective view showing an inlet portion of the outlet pipe shown in FIG. 12.
Figure 24:
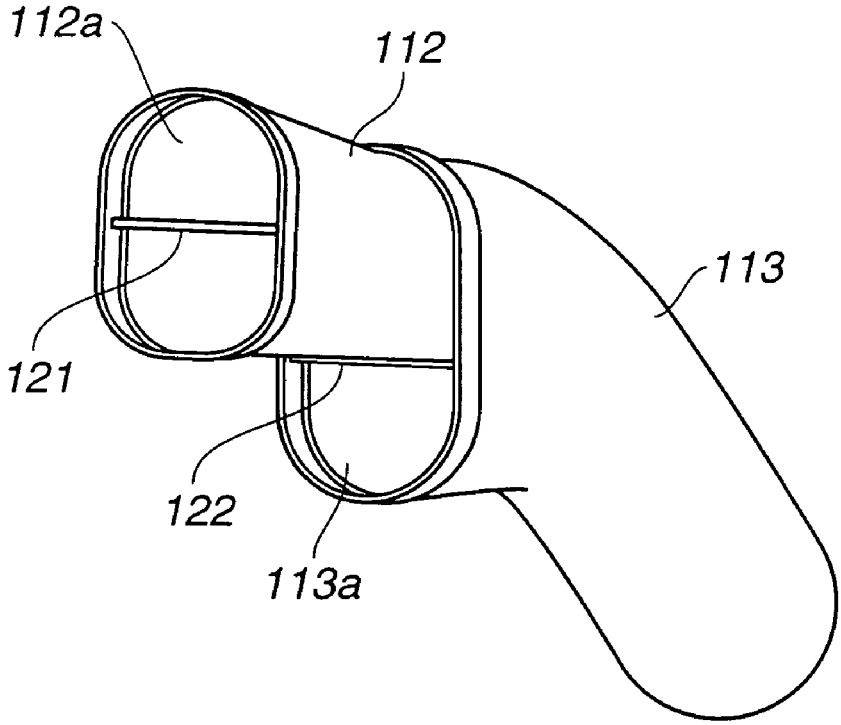
FIG. 24 is a perspective view showing a state that the intermediate pipe is assembled with the outlet pipe.

Further, FIG. 23 is a perspective view showing inlet portion 113*a* of outlet pipe 113, and FIG. 24 is a perspective view showing a state that intermediate pipe 112 is assembled with outlet pipe 113. As shown in FIG. 22, a partition plate 122 is welded at an intermediate portion offset from a center of oval inlet portion 113*a* of outlet pipe 113 so that inlet portion 113*a* is partitioned into a O-shape portion constructed by two D-shaped openings. Downstream end portion 112*b* of intermediate pipe 112 is inserted into the large D-shape opening of inlet portion 112*a* and is welded thereto. Further, downstream end portion 116*b* of fifth-cylinder branch pipe 116 is inserted into the small D-shape opening of inlet portion 112*a* and is welded thereto. An end periphery of inlet portion 113*a* is formed into an engaged portion 113*c* such that a diameter of the engaged portion 112*c* is increased stepwise as compared with the diameter of the following portion of inlet portion 113*a*. By this arrangement, downstream end portions 112*b* and 116*b* are engaged with an inner surface of engaged portion 113*c* so as to achieve the positioning thereof in the axial direction. As is clearly shown in FIG. 24, oval inlet portion 113*a* of outlet pipe 113 is arranged such that a dimension along a miner axis of oval inlet portion 113*a* is approximately equal to that of inlet portion 112 of intermediate pipe 112 and that a dimension along a major axis of oval inlet portion 113*a* is larger than that of inlet portion 112 of intermediate pipe 112.

Figure 25:
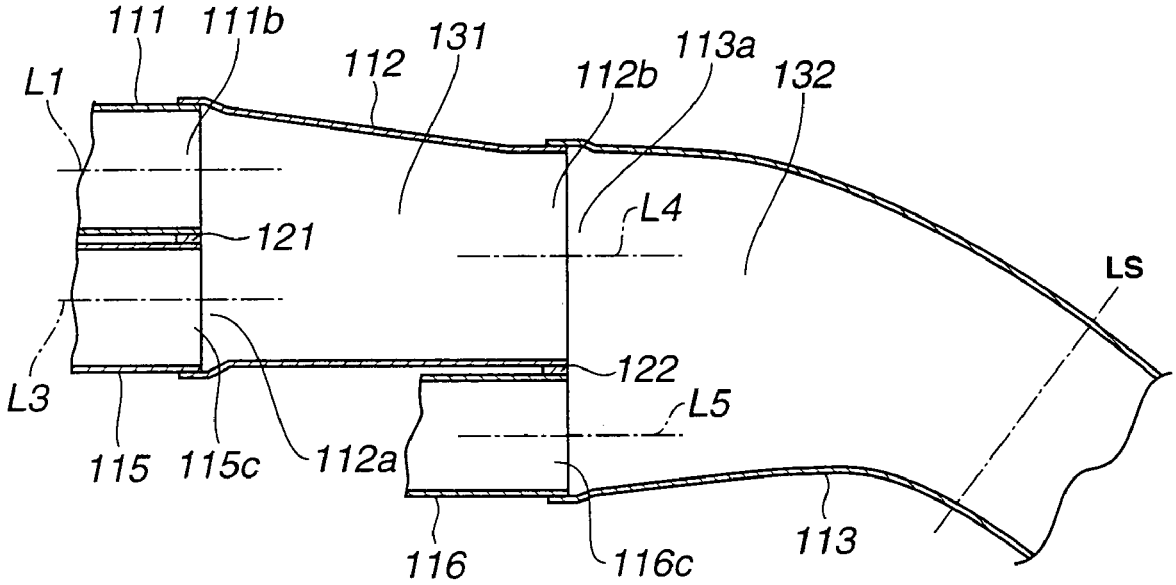
FIG. 25 is a cross sectional view showing collecting portions constructed by the intermediate pipe and the outlet pipe.

FIG. 25 is a cross sectional view showing a collecting portion of intermediate pipe 112 and outlet pipe. As shown in FIG. 25, the secondary exhaust pipe constructed by third-cylinder branch pipe 115 is collected with the primary exhaust pipe constructed by first-cylinder branch pipe 111, intermediate pipe 112 and outlet pipe 113, at inlet portion 112*a* of intermediate pipe 112. An inner space of intermediate pipe 112 is a first voluminous portion 131 having a space of sufficiently attenuating frequency components except for basic order frequency components of the exhaust sound. In other words, a passage of first-cylinder branch pipe 111 and a passage of third-cylinder branch pipe 115 dare collected at first voluminous portion 131 constructed by intermediate pipe 112. Herein, a center axis L1 at downstream portion 111*b* of first-cylinder branch pipe 111 and a center axis L3 at downstream portion 115*c* of third-cylinder branch pipe 115 are set to be parallel with each other. Accordingly, a confluence angle therebetween is substantially 0°. Further, a length of an area, where downstream portion 111*b* of first-cylinder branch pipe 111 and a center axis L3 at downstream portion 115*c* of third-cylinder branch pipe 115 are parallel, has been determined at an appropriate length so that the flow of exhaust-gas flowing from first and third cylinder pipes 111 and 115 does not generate a spiral flow in first voluminous portion 131. A passage cross-sectional area of intermediate pipe 112 functioning as first voluminous portion 131 is set to be sufficiently larger than each passage cross-sectional area of each of first and second branch pipes 111 and 115.

The secondary exhaust pipe constructed by fifth-cylinder branch pipe 116 is collected with the primary exhaust pipe constructed by first-cylinder branch pipe 111, intermediate pipe 112 and outlet pipe 113, at inlet portion 113*a* of outlet pipe 113. An inner space of an upstream portion of intermediate pipe 113 is a second voluminous portion 132 having a space of sufficiently attenuating frequency components except for basic order frequency components of exhaust sounds. In other words, a passage of intermediate pipe 112 and a passage of fifth-cylinder branch pipe 116 are collected at second voluminous portion 132 constructed by outlet pipe 113. Herein, a center axis L4 at downstream portion 112*b* of intermediate pipe 112 and a center axis L5 at downstream portion 116*c* of fifth-cylinder branch pipe 116 are set to be parallel with each other. Accordingly, a confluence angle therebetween is substantially 0°. Further, a length of an area, where downstream portion 112*b* of intermediate pipe 112 and downstream portion 116*c* of fifth-cylinder branch pipe 116 are parallel, has been determined at an appropriate length so that the flow of exhaust gas flowing from intermediate pipe 112 and fifth cylinder pipe 116 does not generate a spiral flow in second voluminous portion 132. A passage cross-sectional area of outlet pipe 113 functioning as second voluminous portion 132 is set to be sufficiently larger than each passage cross-sectional area of each of intermediate pipe 112 and fifth-cylinder branch pipe 116. The passage cross-sectional area of outlet pipe 113 gradually decreases from inlet portion 113*a* toward the downstream. Second voluminous portion 132 defined as an upstream portion upstream of a line LS in FIG. 25 has a volume which is greater than that of first voluminous portion 131 which is located upstream of second voluminous portion 132.

Figure 30:
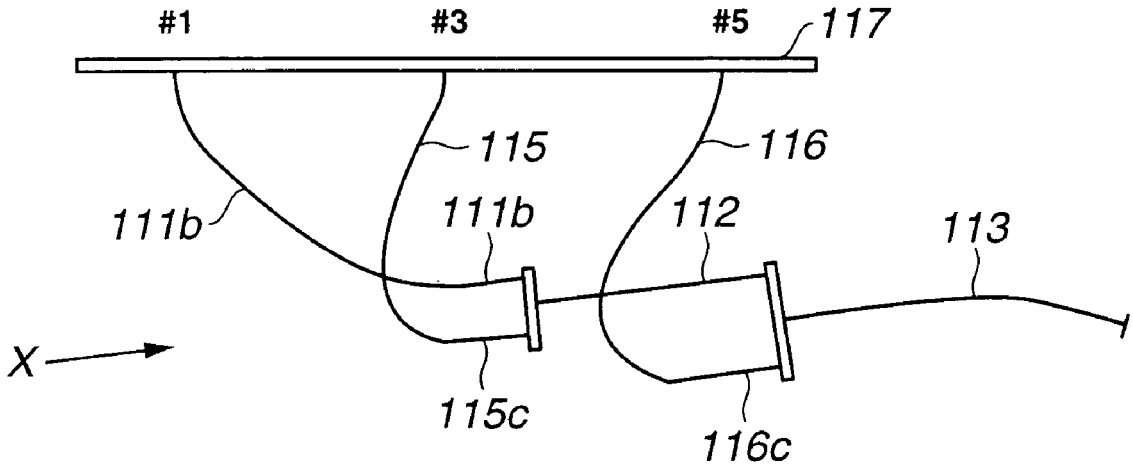
FIG. 30 is a simplified structural view of the exhaust manifold of the second embodiment.

FIG. 30 shows a passage structure model of exhaust manifold 101 of the second embodiment according to the present invention. As discussed above, the primary exhaust pipe constructed by first-cylinder branch pipe 111, intermediate pipe 112 and outlet pipe 113 extends straightly from first cylinder #1 in the rearward direction, as a whole. Third-cylinder branch pipe 115 and fifth-cylinder branch pipe 116 wind around the primary exhaust pipe. The confluence angles α of first-cylinder and second-cylinder branch pipes 115 and 116 relative to the primary exhaust pipe are substantially 0°.

With exhaust manifold 101 of the second embodiment according to the present invention, since third-cylinder branch pipe 115 and fifth-cylinder branch pipe 116 are arranged so as to wind around the outer periphery of the primary exhaust pipe, it becomes possible to substantially equalize the pipe lengths of the exhaust passages ranging from the exhaust ports of the respective cylinders #1, #3 and #5 to front-tube connecting flange 114 and to improve the sound quality of exhaust sound. Specifically, since there are provided first and second voluminous portions 131 and 132 at the collecting portion of third-cylinder branch pipe 115 to the primary exhaust pipe and the collecting portion of fifth-cylinder branch pipe 116 to the primary exhaust pipe, it becomes possible to suppress the increase of frequency components except for the basic order frequency components through the suppression of complex flows in first and second voluminous portions 131 and 132 and to improve the sound quality of the exhaust sound. Further, since the voluminous space is divided into first and second voluminous portions 131 and 132, the increase of the requesting space of exhaust manifold 101 is suppressed.

Since exhaust manifold 101 is arranged to insert two parallel pipes into each of inlet portions 112*a* and 113*a* of the respective intermediate pipe 112 and outlet pipe 113, it becomes possible to set the confluence angle α of each collecting portions at 0°. This arrangement decreases the passage pressure loss at minimum, and therefore the volumetric efficiency of the engine at high-speed condition is improved.

Further, intermediate pipe 112 and outlet pipe 115 of exhaust manifold 101 are provided separately as different parts and are integrally connected with branch pipes 111, 115 and 116 by mean of welding. This simplifies the production of the respective parts and facilitates the assembly thereof. More specifically, the end portions of branch pipes 111, 115 and 116 and intermediate pipe 112 are inserted into openings of intermediate pipe 112 and exhaust pipe 113 and then welded thereto. Therefore, the workability of welding is improved.

Herein, there is discussed an assembly procedure of exhaust manifold 101 of the second embodiment according to the present invention. The respective parts of exhaust manifold 101 have been previously machined into the respective shapes. Further, partition plates 121 and 122 have been previously welded to intermediate pipe 112 and outlet pipe 113, respectively. Upstream end 111*d* of first-cylinder branch pipe and upstream end 115*d* of third-cylinder branch pipe 115 are inserted into openings 118 of installation flange 117 and are welded to installation flange 117. During this process, both of downstream end portions 111*b* and 115*c* are arranged in parallel, and the downstream tip ends of downstream end portions 111*b* and 115*c* are aligned on a line as shown in FIG. 20. Subsequently, the downstream tip ends of downstream end portions 111*b* and 115*c* are inserted into inlet portion 112*a* of intermediate pipe 112 and are welded to intermediate pipe 112 as shown in FIG. 19. Then, upstream end portion 116*d* of fifth-cylinder branch pipe 116 is fixedly welded to installation flange 117. During this process, outlet portion 112*b* of intermediate pipe 112 and downstream end portion 116*c* of fifth-cylinder branch pipe 116 are arranged side by side in parallel, and the downstream ends of intermediate pipe 112 and fifth-cylinder branch pipes 116 are aligned on a line as shown in FIG. 18. Subsequently, the downstream ends of intermediate pipe 112 and fifth-cylinder branch pipe 116 are inserted into inlet portion 113*a* of outlet pipe 113 and are welded to outlet pipe 113. With the execution of these processes, exhaust manifold 101 of the second embodiment according to the present invention is produced.

Although the second embodiment according to the present invention has been shown and described such that partition plates 131 and 132 are provided at inlet portion 112*a* of intermediate pipe 112 and inlet portion 113*a* of outlet pipe 113, they may be omitted. For example, by integrally connecting the end portions of two pipe through welding the adjacent opening peripheries of the end portions of the two pipes, it becomes possible to omit partition plates 121 and 122.

Figure 31:
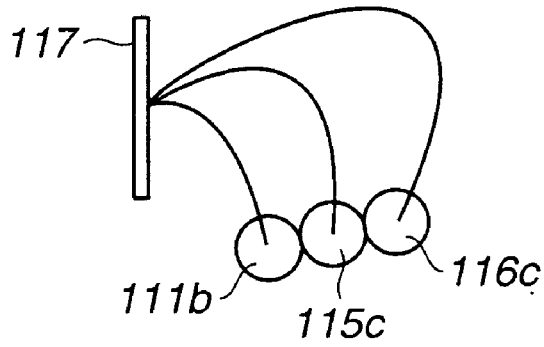
FIG. 31 is a projection view for explaining a positional relationship among the branch pipes.
Figure 32:
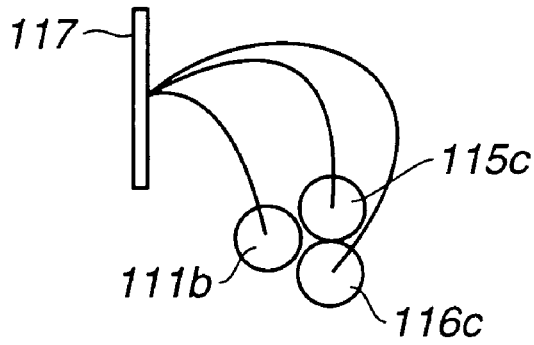
FIG. 32 is a projection view for explaining a positional relationship among modified branch pipes.

While the second embodiment according to the present invention has been shown and described such that downstream end portion 111*b* of first-cylinder branch pipe 111, downstream end portion 115*c* of third-cylinder branch pipe 115 and downstream end portion 116*c* of fifth-cylinder branch pipe 116 are aligned on a line on the projection as shown in FIG. 31, they may be arranged to be located at tops of a triangle on the projection as shown in FIG. 32. By this modified arrangement of branch pipes 111, 115 and 116, it becomes possible to wind fifth-cylinder branch pipe 116 around the outer periphery of intermediate pipe 112 with a further large turn angle and to collect fifth-cylinder branch pipe 116 with outlet pipe 113 under intermediate pipe 112. This arrangement has a merit of further improving the rigidity of exhaust manifold integrated by welding.

Figure 33A:
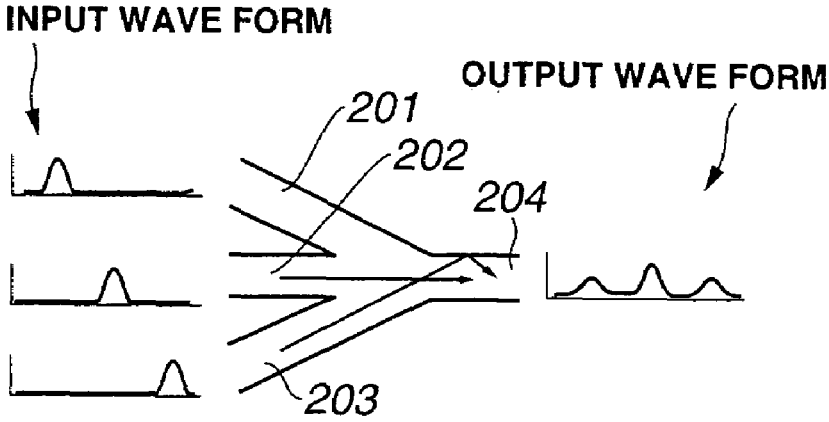
FIGS. 33A and 33B are explanatory views explaining the function of a voluminous portion provided at a collecting portion of the exhaust manifold.
Figure 33B:
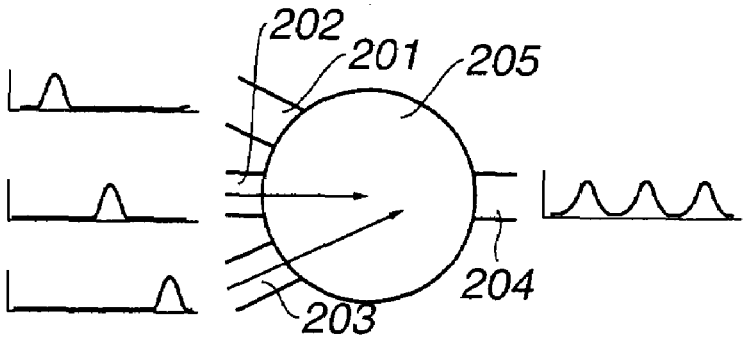

Referring to FIGS. 33A and 33B, there is discussed the operation of the voluminous portion at the collecting portion of the exhaust manifold. As shown in FIG. 33A, when three exhaust pipes 201, 202 and 203 for three cylinders are collected to one exhaust pipe 204, there is a tendency to generate frequency components except for the basic order in exhaust sound even if three exhaust pipes 201, 202 and 203 are equalized in pipe length. More specifically, as shown by wave-form views at the left hand side in FIG. 33A, pressure pulsations of the respective cylinders are sequentially inputted. Therefore, at an output side, peaks are generated by the basic order as shown by wave-form views at the right hand side in FIG. 33A. When the exhaust passages do not comprises a voluminous portion at the collecting portion, the complexity of the flows at the collecting portion increases and a difference of the passage lengths for cylinders are generated. Therefore a difference of the intensities of peaks is generated, and the increase of frequency components except for the basic order frequency components and the attenuation of the basic order frequency components are intensified. This results in the degradation of the sound quality of the exhaust sound.

In contrast, when there is provided a voluminous portion 205 in the exhaust passage as shown in FIG. 33B, the difference of the passage lengths for cylinders are decreased, and therefore the output wave form takes a basic-order wave from where the intensity of peaks become identical. This results in the decrease of the frequency component except for the basic order frequency components. Although three exhaust pipes 201, 202 and 203 are collected at one voluminous portion in FIG. 33B, exhaust manifold 101 of the second embodiment is arranged such that the three exhaust passages are sequentially collected one by one and that a plurality of voluminous portions are provided. This arrangement enables each of the voluminous portions to be formed small in size while ensuring the sufficient advantages thereby. Consequently, it becomes possible to prevent the total size of the exhaust manifold from becoming large.

Figure 34:
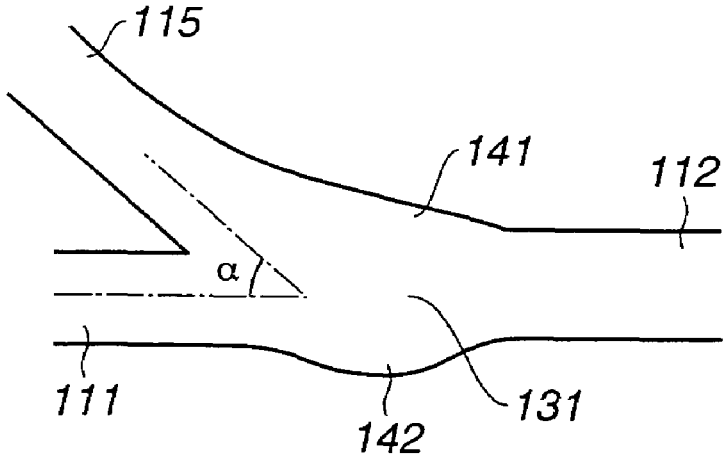
FIG. 34 is an explanatory view of a collecting portion of the exhaust manifold according to a third embodiment of the present invention.

Referring to FIG. 34, there is discussed a third embodiment of the exhaust manifold according to the present invention. The third embodiment of the exhaust manifold is arranged such that the confluence angle $\alpha$ of first-cylinder branch pipe 111 and third-cylinder branch pipe 115 is greater than 0° and that a voluminous portion 131 is formed at the collecting portion. Further, voluminous portion 131 comprises a first expansion portion 141 provided at an outer side of third-cylinder branch pipe at the collecting portion and a second expansion portion 142 provided at an opposite side of first expansion portion 141 so as to be opposite to the passage of third cylinder branch pipe 115. From the viewpoint of decreasing the passage pressure loss, it is preferable that the confluence angle $\alpha$ is set to be smaller than or equal to 30°. The other construction of the third embodiment is basically similar to that of the second embodiment.

Figure 35:
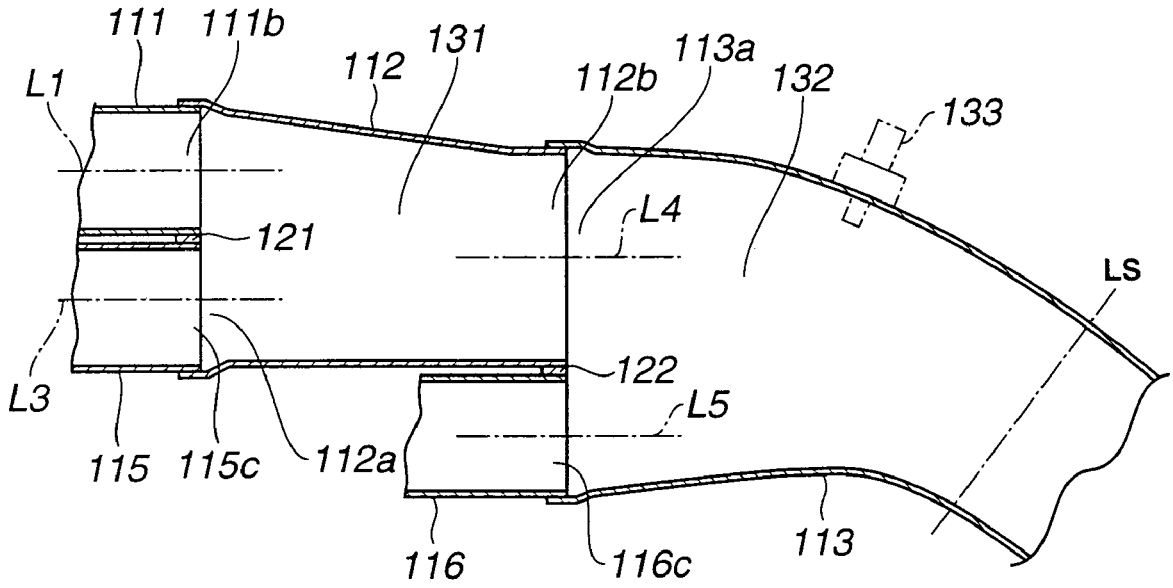
FIG. 35 is a cross sectional view showing collecting portions constructed by an intermediate pipe and an outlet pipe of the exhaust manifold according to a fourth embodiment of the present invention.

Referring to FIG. 35, there is discussed a fourth embodiment of the exhaust manifold 101 according to the present invention. The fourth embodiment is basically the same as the second embodiment except that an air/fuel ratio sensor 133 for detecting an exhaust gas air/fuel ratio is installed at outlet pipe 113 so as to detect an air/fuel ratio of the exhaust gas in second voluminous portion 132 as shown in FIG. 35. An oxygen sensor is representatively employed as an air/fuel ratio sensor.

This application is based on Japanese Patent Applications No. 2003-400990 filed on Dec. 1, 2003 in Japan, and Nos. 2004-68273, 2004-68274, 2004-68275 and 2004-68276 filed on Mar. 11, 2004 in Japan. The entire contents of these Japanese Patent Applications are incorporated herein by reference.

Although the invention has been described above by reference to certain embodiments of the invention, the invention is not limited to the embodiments described above. Modifications and variations of the embodiments described above will occur to those skilled in the art, in light of the above teaching. For example, the invention is not limited to the exhaust manifold for a V-6 engine, and may be adapted to an exhaust manifold installed to one bank of a V-8 engine or to a straight-4 engine. Further, the production method of the exhaust manifold according to the present invention is not limited to the above discussed production method, and the exhaust manifold according to the present invention may be produced by other known methods such as welding of bent pips or casting. The scope of the invention is defined with reference to the following claims.

What is claimed is:

1. An exhaust manifold connected to exhaust ports of at least three straightly-arranged cylinders of an internal combustion engine, comprising:

a primary exhaust pipe extending from a foremost cylinder of the cylinders to a rearward direction of the engine along a direction of a straight arrangement of the cylinders; and a plurality of secondary exhaust pipes extending from the other cylinders besides the foremost cylinder to the primary exhaust pipe, the secondary exhaust pipes being collected with the primary exhaust pipe so that downstream end portions of the secondary exhaust pipes are wound at a winding degree into center axis of the primary exhaust pipe at a plurality of points on the center axis, respectively, wherein the secondary pipes are configured such that the winding degree of each secondary pipe increases and a length of each secondary pipe increases as a position of each secondary pipe increases in distance from the foremost cylinder.

2. The exhaust manifold as claimed in claim 1, wherein the primary exhaust pipe extends from the foremost cylinder in the rearward and a downward direction, wherein the secondary exhaust pipes extend from the other cylinders upwardly above the primary exhaust pipe and to an upstream side of the primary exhaust pipe, wherein the secondary exhaust pipes then curve downwardly and to a downstream side of the primary exhaust pipe and are collected into the primary exhaust pipe.

3. The exhaust manifold as claimed in claim 1, wherein the primary and secondary exhaust pipes are substantially equal in length.

4. The exhaust manifold as claimed in claim 1, wherein the primary exhaust pipe connected to a catalytic converter.

5. The exhaust manifold as claimed in claim 1, wherein the primary exhaust pipe is constructed by a first-cylinder branch pipe, an intermediate pipe connected to a downstream end of the first cylinder branch pipe and an outlet pipe connected to a down stream end of the intermediate pipe, a first one of the secondary exhaust pipes is constructed by a third-cylinder branch pipe which downstream end is connected to the intermediate pipe, and a second one of the secondary exhaust pipe is constructed by a fifth-cylinder branch pipe whose downstream end is connected to the outlet pipe.

6. The exhaust manifold as claimed in claim 1, wherein the downstream end portions of the secondary exhaust pipes are collected with the primary exhaust pipe with a confluence angle relative to the center axis of the primary exhaust pipe so as to be along an extending direction of the primary exhaust pipe.

7. The exhaust manifold as claimed in claim 6, wherein the confluence angle between the center axis of the primary exhaust pipe and a center axis of the downstream end portion of each secondary exhaust pipe is smaller than 30°.

8. The exhaust manifold as claimed in claim 1, wherein the winding degree of each secondary pipe is configured such that, on a projection plane perpendicular to the center axis of the primary exhaust pipe, a turn angle defined by a line connecting an upstream end of each secondary exhaust pipe and the center axis and a line connecting a downstream end of each secondary exhaust pipe and the center axis increases as a position of each secondary pipe increases in distance from the foremost cylinder.

9. The exhaust manifold as claimed in claim 8, wherein the exhaust manifold is configured to be used as an exhaust manifold connected to one bank of a V-type six-cylinder engine, wherein the exhaust manifold is configured such that the turn angle of the secondary exhaust pipe connected to an intermediate cylinder of the bank is within a range from 90° to 180°, and the turn angle of the secondary exhaust pipe connected to a rearmost cylinder of the bank is greater than the turn angle of the secondary exhaust pipe connected to the intermediate cylinder.

10. The exhaust manifold as claimed in claim 1, wherein the secondary exhaust pipes extend from respective cylinders to a forward side of the engine, are then bent toward a backward side of the engine, and are collected to the primary exhaust pipe.

11. The exhaust manifold as claimed in claim 10, wherein an upstream end portion of each secondary exhaust pipe projects from an installation flange obliquely frontward direction.

12. The exhaust manifold as claimed in claim 11, wherein an upstream end portion of the primary exhaust pipe projects from an installation flange toward an obliquely rearward direction.

13. The exhaust manifold as claimed in claim 1, wherein a confluence angle between the center axis of the primary exhaust pipe and a center axis of each secondary exhaust pipes at a collecting point between the primary exhaust pipe and each of the secondary exhaust pipes, is substantially 0°.

14. The exhaust manifold as claimed in claim 13, wherein a downstream end portion of the primary exhaust pipe and the downstream end portions of the secondary exhaust pipe are collected and are arranged in parallel.

15. The exhaust manifold as claimed in claim 13, wherein the primary exhaust pipe and the downstream end portions of two secondary exhaust pipes are arranged in a row on a projection as viewed from a front side of the engine.

16. The exhaust manifold as claimed in claim 13, wherein the primary exhaust pipe and the downstream end portions of two secondary exhaust pipes are arranged to be located at tops of a triangle on a projection as viewed from a front side of the engine.

17. The exhaust manifold as claimed in claim 1, wherein a collecting portion between the primary exhaust pipe and each of the secondary exhaust pipe is formed into a voluminous portion.

18. The exhaust manifold as claimed in claim 17, wherein a confluence angle between a center axis of the primary exhaust pipe and a center axis of the secondary exhaust pipe at a downstream end portion of the branch pipe is substantially 0°.

19. The exhaust manifold as claimed in claim 17, wherein the voluminous portion is formed by setting a cross sectional area of the collecting portion at a value greater than a cross sectional area at an upstream collection portion upstream of the collecting portion.

20. The exhaust manifold as claimed in claim 17, wherein a volume of a downstream one of the voluminous portions is greater than a volume of an upstream one of the voluminous portions as compared with the downstream one.

21. The exhaust manifold as claimed in claim 17, wherein an air-fuel ratio sensor is installed in one of the voluminous portion.

22. The exhaust manifold as claimed in claim 1, wherein the primary exhaust pipe is constructed by a branch pipe, at least one of an intermediate pipe connected to a downstream end portion of the branch pipe and an outlet pipe connected to a downstream end portion of the intermediate pipe, and each of the secondary exhaust pipes is constructed by a branch pipe.

23. The exhaust manifold as claimed in claim 22, wherein the downstream end portions of the two branch pipes inserted in an inlet portion of the intermediate portion are arranged in parallel, and the downstream end portion of the intermediate portion and the downstream end portion of the branch pipe are arranged in parallel.

24. The exhaust manifold as claimed in claim 22, wherein a periphery of the inlet portion of the intermediate pipe is enlarged in diameter so as to be engaged with the branch pipes.

25. The exhaust manifold as claimed in claim 22, wherein a collecting portion of each of the intermediate pipe and the outlet pipe is formed into a voluminous portion.

26. The exhaust manifold as claimed in claim 22, wherein a periphery of the inlet portion of the outlet pipe is enlarged in diameter so as to be engaged with at least one of the branch pipes and the intermediate pipe.

27. The exhaust manifold as claimed in claim 22, wherein the downstream end portions of the branch pipes inserted into the inlet portion of the intermediate pipe are formed into D-shape cross-section, and the inlet portion of the intermediate pipe is formed into an oval cross section.

28. The exhaust manifold as claimed in claim 27, wherein a partition plate is fixed in the inlet portion of the intermediate pipe so as to define the inlet portion into a shape of character θ, and two of the end portions of the branch pipes into the inlet portion formed in D-shape cross section.

29. The exhaust manifold as claimed in claim 27, wherein a partition plate is fixed in the inlet portion of the outlet pipe so as to define the inlet portion into a shape of character θ, and the downstream end portions of the branch pipe and the intermediate pipe are inserted into the inlet portion formed in D-shape cross section.

* * * * *